US005403383A

United States Patent [19]

Jaisinghani

[11] Patent Number: 5,403,383

[45] Date of Patent: Apr. 4, 1995

[54] SAFE IONIZING FIELD ELECTRICALLY ENHANCED FILTER AND PROCESS FOR SAFELY IONIZING A FIELD OF AN ELECTRICALLY ENHANCED FILTER

[76] Inventor: Rajan Jaisinghani, 4200 Northwich Rd., Midlothian, Va. 23112

[21] Appl. No.: 26,324

[22] Filed: Jan. 28, 1993

Related U.S. Application Data

[63] Continuation-in-part of Ser. No. 935,875, Aug. 26, 1992, abandoned.

[51] Int. Cl.[6] ..... B03C 3/14

[52] U.S. Cl. ..... 95/69; 55/279; 95/70; 95/78; 95/79; 96/58; 96/59; 96/62; 96/67; 96/68; 96/96; 96/99; 422/4; 422/22

[58] Field of Search ..... 95/63, 69, 70, 79, 78; 96/17, 55, 57, 58, 59, 62, 65-69, 99, 96; 55/360, DIG. 39, 279; 422/4, 5, 22, 121

[56] References Cited

U.S. PATENT DOCUMENTS

| | | | |
|---|---|---|---|
| 3,910,779 | 10/1975 | Penney | 55/155 X |
| 3,979,189 | 9/1976 | Alskog | 55/155 X |
| 4,018,577 | 4/1977 | Shibuya et al. | 55/138 X |
| 4,317,661 | 3/1982 | Sasaoka et al. | 55/155 X |
| 4,509,958 | 4/1985 | Masuda et al. | 55/132 |
| 4,715,870 | 12/1987 | Masuda et al. | 55/138 X |
| 4,750,921 | 6/1988 | Sugita et al. | 55/138 X |
| 4,781,736 | 11/1988 | Cheney et al. | 55/138 X |
| 4,853,005 | 8/1989 | Jaisinghani et al. | 55/132 |
| 4,940,470 | 7/1990 | Jaisinghani et al. | 55/131 X |
| 5,185,015 | 2/1993 | Searle | 55/279 X |

OTHER PUBLICATIONS

* Reference Was Cited In Parent Case Ser. No. 07/935,875.

Jaisinghani, et al., "Advantages of Electrically Stimulated Air Filtration Over Conventional Filtration", Fluid Particle Separation Journal, Dec. 1988.

Jaisinghani, et al., "Effect of Relative Humidity on Electrically Stimulated Filter Performance", APCA Journal, Jul. 1987.

Jaisinghani, et al., "Performance Characteristics of a Two Electrode Ionizing Electrically Stimulated Filter", Annual Meeting of the Fine Particle Society, Jul. 1988.

*Primary Examiner*—Richard L. Chiesa

*Attorney, Agent, or Firm*—Robert E. Bushnell

[57] ABSTRACT

An electrostatically stimulated air filter and process, contemplates a housing having an fluid intake and a fluid exhaust; a upstream electrode, disposed downstream of the fluid intake, for carrying a ground potential; a filter, disposed downstream of the prefilter, for filtering out contaminants in the fluid; an ionizing electrode, disposed between the filter and the prefilter, for carrying a second potential; and a downstream electrode, disposed downstream of the filter, for carrying a ground potential; and a fan, downstream of the filter, for driving air through the prefilter and the filter. Ionization of incoming fluid occurs as a result of electric fields generated by the downstream electrode, the ionizing electrode, and the upstream electrode. The filter comprises an upstream dielectric layer and a downstream conductive layer, usually fibers coated with activated carbon powder.

63 Claims, 21 Drawing Sheets

SAFE IONIZING FIELD ELECTRICALLY ENHANCED FILTER AND PROCESS FOR SAFELY IONIZING A FIELD OF AN ELECTRICALLY ENHANCED FILTER

CROSS-REFERENCE TO RELATED APPLICATIONS

This application is a continuation-in-part of, makes reference to, and claims all benefits accruing under 35 U.S.C. §120 resulting from my application entitled SAFE ELECTROSTATICALLY STIMULATED FILTERING DEVICE, earlier filed in the U.S. Patent & Trademark Office on 26 Aug. 1992, and assigned Ser. No. 07/935,875, and now abandoned.

BACKGROUND OF THE INVENTION

1. Field of the Invention

The present invention relates to an electrostatically stimulated fluid filter, and more specifically to an electrostatically stimulated air filter having an upstream control grid, an ionization grid, a downstream filter having a conductive backing, and ground potential grid.

2. Description of Related Art

Conventional electrostatically stimulated filtration (i.e., "ESF") devices, with or without pre-chargers-/ionizers, use a dielectric filter media interposed between a high voltage and ground potential flat porous metal grids or screen electrodes. See Jaisinghani, R. A., Hamado, T. A., Hawley, C. W., *Electrically Stimulated Filter Method and Apparatus*, U.S. Pat. No. 4,853,005, filed 1 Aug. 1989 (hereinafter Jaisinghani '005). Typically, the filter media is in pleated form to increase surface area and thereby facilitate air flow and dust collection. The pleated form, however, results in a relatively high gap between electrodes. This gap requires the application of high voltage, typically 16–28 kilo-Volts, kV, in order to achieve the required high applied field strengths (typically 1.5 kV/cm to 2.5 kV/cm). See Jaisinghani, R. A. and T. A. Hamade; *Effect of Relative Humidity on Electrically Stimulated Filter Performance*, J. of APCA, Vol 37, 823–828, 1987 (hereinafter Jaisinghani and Hamade); R. A. Jaisinghani and N. J. Bugli; *Performance Characteristics of a Two Electrode Ionizing Electrically Stimulated Filter*, Proceeding Symposium on Contamination Control and Clean Room Tech., 19th Ann meet, Fine Particle Society, Santa Clara, Calif., July 1988; R. A. Jaisinghani and N. J. Bugli; *Advantages of Electrically Stimulated Filtration over Conventional Filtration, Fluid/Particle Sep. J.*, Vol 1, No 2, 1988. In contrast, in rare cases fiat depth filter mats are used.

The requirement of high electrical potentials and the application of high voltage directly to the filter have several drawbacks. First, the materials used in the construction of the filter must have high dielectric strength and high resistance to arc tracking, increasing the cost of such filters. Second, the cost of the high voltage power supply is expensive since its cost is dependent upon the output voltage, among other variables such as power. Third, special attention is needed in the design of filter housings since large insulating air gaps and insulators are required between the high and low potential components. Fourth, components at very high voltage can be a safety hazard since under certain conditions sparks occur which can ignite the filter components. Fifth, as the high voltage components and inside ground potential surfaces of the filter housing become contaminated, conductive tracks result which draw power from the high voltage supply, and in some cases results in short circuits and sparks (n.b., many common aerosols, such as cigarette smoke, are fairly conductive, especially when carbonized within the high fields). All these factors necessitate cost additions which increase the cost of ESF technology and thereby reduce its application.

The requirement of the very high voltage can be partially overcome by using thin glass paper filter media along with corrugated aluminum spacers in between pleats of this filter media. See Masuda, S., *High Efficiency Electrostatic Filter Device*, U.S. Pat. 4,509,958, issued on 9 Apr. 1985. These corrugated aluminum spacers arc alternately connected to high and low voltage output of a power supply. This configuration significantly reduces need for high voltage. Since the corrugated aluminum spacers have some depth, the main field strength is approximately equal to the distance between the centerlines of corrugated electrodes which is approximately equal to the pleat spacing. One limitation or drawback of this configuration is that the corrugated aluminum spacers tend to tear the delicate fiber glass paper filter media. This possibility of tearing results in quality control problems that negate the advantages of the lower voltages. Another limitation of this configuration is that the high voltage must be applied directly to each the filter element. The application of the high voltage is typically accomplished with flat metal grid electrodes contacting each corresponding spacer. This results in additional cost, since the manufacturing process must ensure that each and every spacer is in contact to the corresponding grid electrode—no easy task since an clement may have over a hundred spacers. Further, as the filter material becomes relatively conductive due to contamination the power requirement increases exponentially and additionally there is a danger of igniting the filter material. This effect also occurs in a high relative humidity atmosphere.

Newer designs have eliminated the need for direct application of a high voltage to the filter by incorporating the filter within the ionizer using a single ground electrode. See Jaisinghani, R. A. and N. J. Bugli; *Single Field Ionizing Electrically Stimulated Filter*, U.S. Pat. No. 4,940,470, issued on 10 Jul. 1990 (hereinafter Jaisinghani '470). The primary advantage of this design is that only one high voltage electrode is used simplifying the construction of the housing. On the other hand, this design has several drawbacks. First, since a dielectric material is between the high voltage ionizing wires and the ground plate, ionization is suppressed at moderate field strengths and extremely high voltages, at least 26 to 28 kV is required in order to achieve adequate charging of incoming particles. Second, the required high voltages create all the disadvantages associated with previously discussed conventional ESF technology. Third, as the filter becomes contaminated, the field strength in the gap between the filter and the ionizing wires increases causing an increased current and sparking towards the potentially combustible filter, necessitating a highly regulated power supply which is costly.

SUMMARY OF THE INVENTION

It is therefore, one object of the present invention to provide an improved electrically stimulated filtering device.

It is another object to provide a safe electrically stimulated filtering device.

It is still another object is to provide a device which charges incoming particles by having an adequate field strength without the direct application of voltage to filter material.

It is yet another object is to provide a device using voltages to thereby minimize the danger of sparks through the filter material resulting from a contaminated filter, or resulting from high humidity.

It is still yet another object is to provide a device such that no sparking can occur towards the filter material, even if it is contaminated or if an overvoltage condition occurs.

It is a further object of the invention is to enhance the efficiency of a pleated filter material while at the same time retaining the high permeability of the filter material.

It is a still further object to provide a suitable filter material such as a composite material capable of also adsorbing volatile organic compounds (VOCs) and other contaminant gases.

It is also as object to provide a device that traps and destroys bacterial and other harmful biological organisms by exposing the organisms to high levels of ionizating radiation.

It is also a further object to provide a device to trap radon progeny particles which are typically highly charged, by using the electrical fields in the device to draw those particles into the filter.

These and other objects may be achieved according to the principles of the present invention with an electrostatically stimulated filtering device comprising: a housing having a fluid intake and a fluid exhaust; an upstream electrode, disposed downstream of the fluid intake, for carrying a ground potential; filter material, disposed downstream of the upstream electrode, for filtering out contaminants in the fluid; an ionizing electrode, disposed between the filter material and the upstream electrode, for carrying a second potential; and a downstream electrode, disposed downstream of the filter material, for carrying a ground potential; and a fan, downstream of the filter material, for driving air through the filter material. Ionization of incoming fluid occurs as a result of electric fields generated between the downstream electrode, the ionizing electrode, and the upstream electrode. The filter material comprises an upstream dielectric layer with or without a downstream conductive layer, such as, for example, fibers coated with activated carbon powder. The downstream conductive layer, if used, is in electrical contact with the downstream electrode

DESCRIPTION OF THE PREFERRED EMBODIMENTS

First Embodiment of a Filter and Electrode Portion

Figure 1:
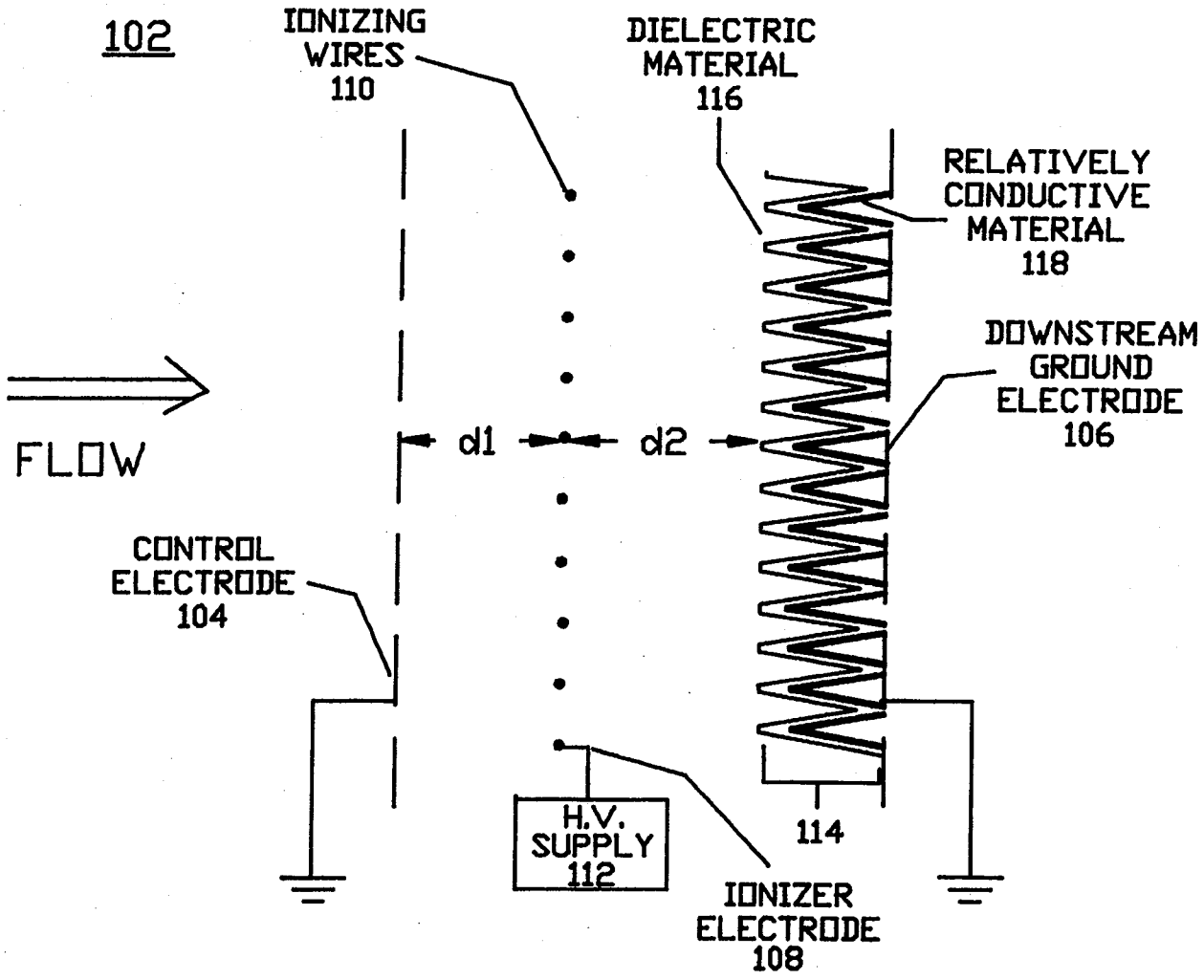
FIG. 1 is a schematic cross-sectional view of a first embodiment of a filter and electrode portion for an electrostatically stimulated filtering device according to the present invention.

Referring now to the figures, FIG. 1 is a cross-sectional view of the first embodiment of the filter and electrode portion 102. In FIG. 1, the filter and electrode portion 102 includes two ground electrodes, namely an upstream or control electrode 104 and a downstream ground electrode 106. The ground electrodes 104, 106 are constructed of a porous conductive material, typically a flattened and expanded aluminum grid, screen or mesh. Each of the ground electrodes 104, 106 are maintained at a lower potential than an ionizer electrode 108. The ionizer electrode 108 incorporates high voltage ionizing wires 110 which are energized by a high voltage direct current power supply 112.

The first embodiment of the filter and electrode portion 102 also includes composite filter material 114 which is pleated to increase surface area allowing for capture of a greater quantity of contaminants. Typically, the composite filter material 114 comprises dielectric material 116, such as glass or other plastic fiber material having a low dielectric and low conductivity. The composite filter material also comprises relatively conductive material 118 such as glass or plastic fiber material coated with carbon or other conductive material rendering the relatively conductive material considerably more electrically conductive than the dielectric material 116. The relatively conductive material 118 contacts the dielectric material 116 and is located against and in contact with the downstream ground electrode 106.

The use of the composite filter material 114 incorporating the relatively conductive material 118 is necessary, especially when the pleat depth of the filter material increases over approximately two inches, because of the increased gap between the filter material and the flat downstream ground electrode 106. Since a significant portion of the dielectric material 116 is not in contact with the downstream ground electrode 106, the electrical field strength across the filter material would be significantly reduced if no relatively conductive material 118 were used.

The relatively conductive material 118 effectively reduces the gap between the ionizing wires 110 and the downstream ground electrode 106. The relatively conductive material 118 is preferably made of fibers coated with activated carbon powder or activated carbonized fibers. Typically, a volume resistivity of $9\times10^6$ ohms per centimeter and a surface resistivity of $8\times10^6$ ohms are suitable. Corresponding values for the non conductive dielectric material 116, typically fiberglass, are $1\times10^{14}$ ohms per centimeter and $1\times10^{13}$ ohms. By using the relatively conductive material 118, the ground potential of the downstream ground electrode 106 is brought closer to the dielectric material 116 and more evenly distributed throughout the peaks and valleys of the pleats. This configuration results in increased current flow or ionization downstream of the ionizing wires 110 thereby providing adequate charging or polarization of the dielectric filter material 116 and consequently a higher efficiency. The results are shown in TABLE 1, and clearly illustrate the effectiveness of the above-described configuration. Note that the efficiency of the single filter material can be increased to equal that of the composite filter (Table I)—only by increasing the applied voltage.

Instead of using a separate relatively conductive material layer 118, it is also feasible to apply a conductive powder coating of activated carbon on the downstream side of the dielectric material 116. The light (approx. 1 to 10 grams/ft$^2$) carbon powder coating is attached to the dielectric medium 116 by application of an adhesive spray. This results in a surface resistivity of the downstream side to be lower ($1\times10^8$ to $1\times10^6$ ohms depending on the amount of carbon applied) than the surface resistivity of the upstream side of the dielectric medium ($1\times10^{11}$ to $1\times10^{12}$ ohms. Note that the direct application of the carbon to the downstream side of the dielectric material 116 decreases the surface resistance of the upstream side. The downstream side however, is still significantly (by about 3 to 6 orders of magnitude) relatively more conductive than the upstream side. The volume resistivity of the dielectric medium is lowered by about 1 to 2 orders of magnitude ($1\times10^{11}$ to $1\times10^{12}$ ohm/cm depending on the amount of carbon applied). At this volume resistivity however, the material still retains its bulk dielectric qualities required for efficient filtration under electric field application.

The advantages of this direct coating technique are as follows: 1) since now there is little or no thickness of the separate relatively conductive material (the applied layer of carbon), more dielectric filter material can be used to increase pleat density, resulting in lower pressure drop or air flow resistance; and 2) since there is no need for a separate relatively conductive material 118 and also since the carbon coating required is low (and in fact must be fairly low so that the porosity of the dielectric material is not significantly reduced), the material cost is lower than with the use of a separate carbon coated material. The disadvantages of this development is that since low amounts of carbon are used the VOC (gas impurities) removal is very low.

TABLE 1

REFINEMENT FOR THE PLEATED CONFIGURATION
d1 = 0.5", d2 = 0.625", 8 kilo-Volts applied voltage

| CONFIGURATION | VELOCITY ft/m | 0.3 Um EFFICIENCY |
|---|---|---|
| FLAT DIELECTRIC MATERIAL | 238 | 52% |
| 2" PLEATED DIELECTRIC MATERIAL SINGLE LAYER | 238 | 26% |
| 2" PLEATED DIELECTRIC + CONDUCTIVE COMPOSITE | 238 | 63% |

Another advantage of the composite filter material 114 is that the activated carbon conductive material of the relatively conductive material 118 removes volatile organic compounds (VOCs) and other gaseous contaminants in addition to increasing the particulate removal efficiency. Other conductive materials, for example pleated metal screens, may also be used in place of the activated carbon. VOC adsorption may not result, however, unless the material has activated surfaces for physical adsorption.

In FIG. 1, a gap d2 is defined between the upstream side of the composite filter material 114, the peaks, and the ionizing wires 110. A gap d1 is also defined between the ionizing wires 110 and the control electrode 104. The absolute sizes of these gaps d1, d2 relative to the voltage applied between the ionizer electrode 108 and the two ground electrodes 104, 106 is critical to the design. Further, the sizes of the gaps d1, d2 relative to each other is also important.

The control electrode 104 performs dual functions of both acting as a safety conduit for spark discharge and providing an unshielded counter potential electrode facilitating a significant portion of the ionization of incoming air. In the case of the single field ionizing filter (see Jaisinghani '470), the dielectric filter material reduces ionization between the wires and the downstream ground electrode, thereby requiring a very high voltage. In contrast, the unshielded presence of the control electrode 104 in close proximity to the ionizing wires 110 in addition to the general close proximity of the downstream ground electrode 106 of the instant invention produces significant ionization at much lower voltages. For example, for the configuration discussed above, high charge levels of approximately 120–130 micro-coulombs ($\mu$C) per gram of dioctylpthalate test oil (DOP) aerosol are produced which is 2 to 3 times higher than the charge level produced in single field devices, see Jaisinghani '470, operating at 28 kilo-Volts. These higher charge levels are a result of the unshielded presence of the control grid creating the formation of a more symmetrical space charge density around the ionizing wires 110 which facilitates ionization at lower voltages.

Considering the sizes of the gaps d1, d2 relative to each other, distances d1 and d2 must be adjusted so that if the potential or voltage of the ionizer electrode 108 is increased to a spark discharge level, the electrical spark discharge will always occur to the control electrode 104, and not towards or through the potentially combustible composite filter material 114. In other words, d1 and d2 are adjusted so that upstream resistance to arcing is less than a downstream resistance to arcing. To achieve this design criterium, the gap d1 is chosen to be less than the gap d2 plus thickness of the dielectric filter material 116. On the other hand, the distance d2 plus the thickness of the dielectric filter material 116 must not be so much larger than d1 as to reduce the electric field across the filter in the direction of the downstream ground electrode 106 to a great extent.

Considering the absolute sizes of the gaps d1, d2, the gaps must be low enough to generate an almost uniform space charge around the ionizer wires 110 so as to achieve significant current flow in all directions. Furthermore, as is also discussed below in reference to TABLE 2, if the sum of the distance d2 plus the dielectric filter material thickness increases, the ionization downstream is significantly reduced, and the efficiency is reduced. Still further, if d1 is very small, current control is difficult to obtain because a slight increase in voltage can suddenly cause spark discharge whereas a slightly lower voltage will result in almost no current.

As demonstrated below with reference to TABLE 2, both ground electrodes 104, 106 are necessary to produce significant ionization or current flow at the voltages used in this embodiment. However, since the distance from the ionizing wires 110 to the control electrode 104 is less than the distance from the ionizing wires 110 to the downstream ground electrode 106, and since a dielectric material shields the downstream ground electrode, a higher percentage of the total current used is transported through the control electrode.

There is no convenient quantitative method for calculating the absolute sizes of d1 and d2 nor the relative sizes of d1 and d2 since these variables are dependent upon the pleat depth, pleat density, dielectric constant, conductivity of the filter material, allowable limit of high voltage, and the base dimension of d1. These variables are interdependent. For example, if the pleat depth is very large, i.e., greater than four inches, the conductivity of the relatively conductive material 118 needs to be increased so as to maintain the field in the downstream direction. The only general guideline is that d1 is less than the sum of d2 plus the thickness of the dielectric filter material 116, such that increasing the voltage will cause sparking towards the control electrode and such that a significant field strength exists across the filter material in the direction of the downstream electrode 106.

Second Embodiment for the Filter and Electrode Portion

Figure 2:
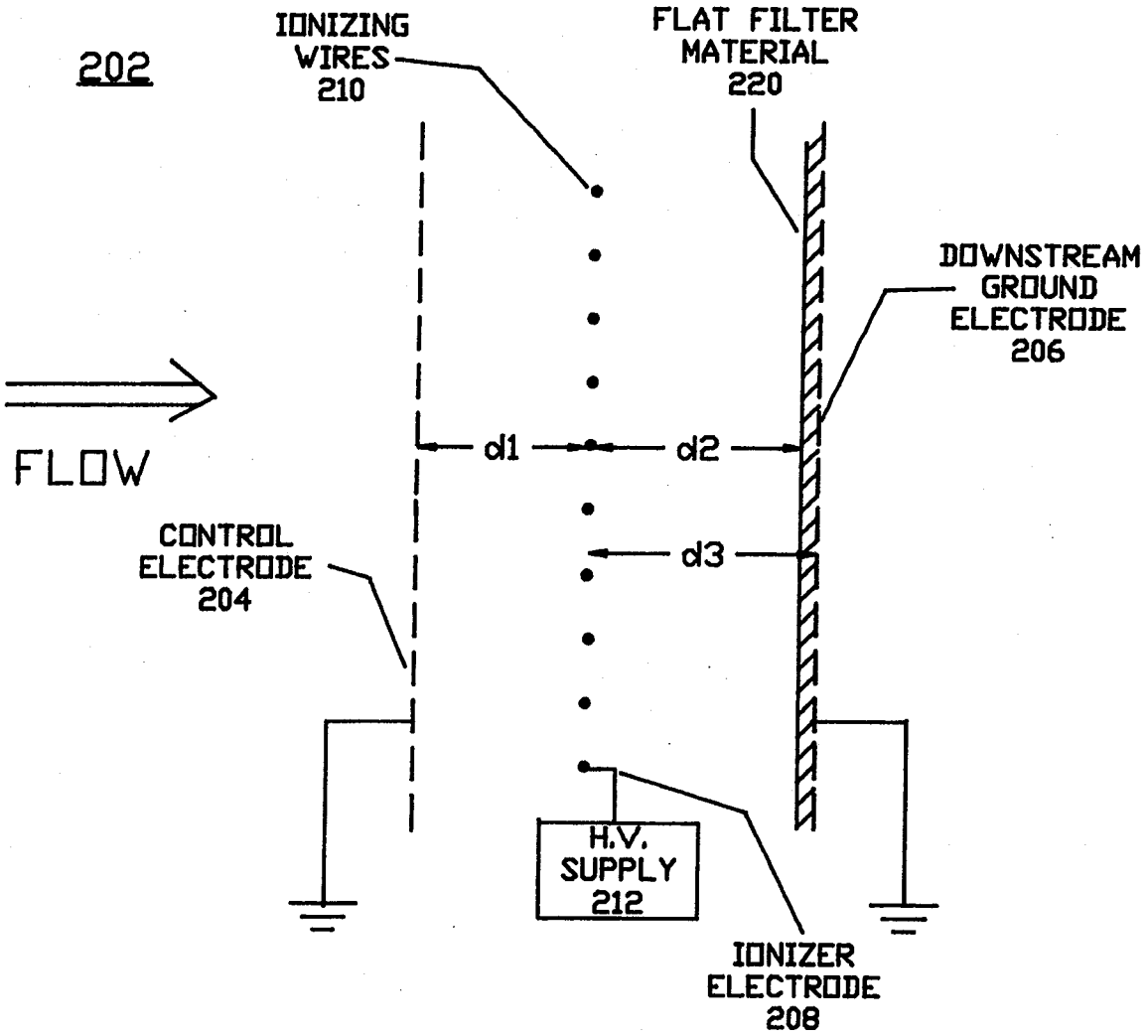
FIG. 2 is a schematic cross-sectional view of a second embodiment of the filter and electrode portion.

FIG. 2 illustrates an alternative embodiment of the filter and electrode portion 202. In FIG. 2, like elements are designated by the similar reference numerals. Alternatively to the first embodiment of the filter and electrode portion 102 of FIG. 1, dielectric filter material 220 may be used as is shown in FIG. 2. The dielectric filter material 220 is not a composite but instead consists of dielectric material only. This filter material is placed essentially in contact with the upstream face of the downstream electrode. The dielectric filter material 220 may be used either as a flat sheet, as shown in FIG. 2 or in a pleated form. As discussed with regard to the first embodiment, if the pleated form is used, the embodiment will be ineffectual as the pleat depth increases over approximately two inches, unless this is compensated for by increasing the applied voltage.

If conductive material as in FIG. 1 is not used along with the dielectric material, then the distance between the ionizing wires 210 and the downstream ground electrode 206, d3, becomes critical to design. The gap d3 is important since the flat dielectric filter material 220 of FIG. 2 does not incorporate the relatively conductive material 118 which lowers downstream resistance to arcing in the embodiment of FIG. 1. Therefore, in embodiment of FIG. 2 incorporating the flat dielectric filter material 220, and also in the case of pleated filter material without the conductive material, the field strength across the filter (in a downstream direction), and the field strength towards the control electrode are generally a function of the distances d1 and d3.

As in the case of the first embodiment of FIG. 1, arcing in the embodiment of FIG. 2 should be directed to the control electrode 204. In addition to preventing sparks (due to erratic short voltage spikes that occur significantly in inexpensive high voltage power supplies used in air filtration applications) towards the potentially combustible filter media components, there is another major benefit of this feature. In typical contamination control applications, most of the contaminants arc typically non conductive. Some essentially non-conductive contaminants such as cotton dust and environmental tobacco smoke (ETS), etc. however, can become conductive if the deposits on the filter are carbonized as a result of sparks discharge towards the filter. This can then lower the resistance to sparking towards the filter. Since the values of d1 and d3 (d2 in the case of the conductive media) are chosen to prevent such spark discharge the resistance to sparking towards the filter is not significantly altered by contaminants such as cotton dust or ETS that can become carbonized under spark discharge. Both configurations (composite and single dielectric media) are also able to handle conductive contaminants to "a" practical limits governed by pressure drop and power supply current limit considerations as discussed in a following section. This additional benefit prevents the conversion of non conductive contamination (to conductive state via carbonization) and thus minimizes the load of the conductive contaminant that may accumulate on the filter. This enhances the useful life of the filter by increasing the time period during which the current load demanded by the filter, is within the practical limits of the power supply. To achieve this, d1 is designed to be less than d3 in the embodiment of FIG. 2 and also in the case of pleated filter material without any conductive backing. The ratio of d1/d3 (FIG. 2) is chosen to be between 0.45 to 0.95.

Alternatively, activated carbon material may be also combined with the flat dielectric filter material 220 of FIG. 2 in order to achieve gas adsorption without significant loss of particulate removal efficiency. In this case, however, the conductive material does not significantly alter the field strength in the downstream direction, and therefore, d3 is still the critical distance.

Design Considerations for Selecting d1 and d2 (or d3)

Figure 6:
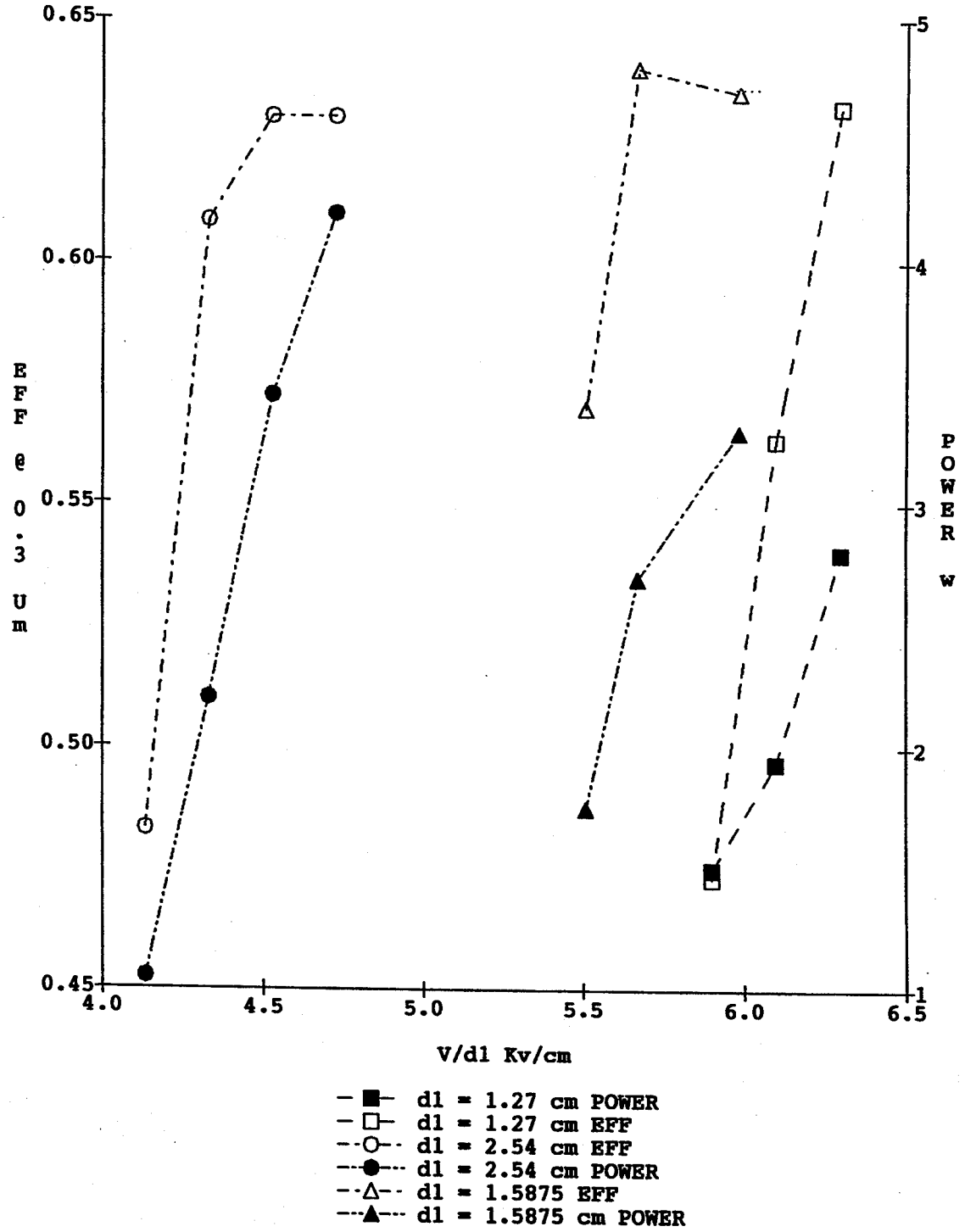
FIG. 6 is a graph showing the effect of the apparent ionizer field (kV/cm) on performance.

For a fixed and suitable (i.e., within the bounds described above) value of the ratio of d1/d2 for the composite filter material described in the following embodiment (or of d1/d3 for the case of a flat dielectric filter material 220) the fundamental variables are d1 and the applied high voltage, $V_{app}$. The efficiency enhancement and high voltage power requirements are independently affected by the "apparent" field strength towards the control electrode $V_{app}$/d1 and the value of d1 for a fixed ratio of d1/d2 or of d1/d3. The effect of these primary variables is illustrated in FIG. 6. Note that FIG. 6 corresponds to a two inch deep pleated filter made with the composite filter material (dielectric material combined with the relatively conductive material) with a ratio of d1/d2 of 0.8 and cross sectional area of 11"×11". Similar trends occur for the case of the flat or pleated dielectric filter material without a conductive backing. As shown in FIG. 6, the dashed curve marked by solid squares represents a function of power (the right ordinate) in an embodiment with d1 =1.27 cm; the dashed curve marked by empty squares illustrates efficiency (left ordinate) with the same embodiment having d1=1.27 cm. The dashed and dotted curve marked by empty circles illustrates the efficiency of an embodiment with d1=2.54 cm, while the dashed and dotted curve marked with solid circles represents power for an embodiment with d1=2.54 cm. The dashed and dotted curve marked by empty triangles represents the efficiency of an embodiment with d1=1.5875 cm, while the dashed and dotted curve marked by solid triangles represents power for an embodiment with d1=1.5875 cm. The general trends, as evident from FIG. 6, are as follows:

1) As d1 increases the "apparent" field strength required to achieve a desired efficiency enhancement decreases, and vice versa. The actual value of the applied voltage however, increases with an increase in d1;

2) As d1 increases for any desired efficiency, the power consumption decreases and vice versa;

3) As d1 increases the power consumed with respect to the apparent field strength $V_{app}$/d1, decreases and vice-versa. This, therefore, allows for higher tolerances in the manufacturing of such air cleaners; and 4) For a fixed value of d1, the efficiency increases asymptotically towards a limiting value as the apparent field strength, $V_{app}$/d1, increases and the power consumed also increases with this field strength.

Based on these observations, it is advantageous to use as high a value of d1 as practical, without exceeding a practical upper limit of the applied voltage such that all the previously discussed disadvantages of high voltage requirements do not affect the design.

With composite filter material, ratio of d1/d2 should be between 0.5 to 0.95, but a more practical range for d1/d2 is 0.6 to 0.8. A good value of d1 is between 0.375" to 1.25", with an apparent field strength, $V_{app}$/d1 of about 4.5 to 7.5 kilo-Volts per centimeter. These conditions typically result in applied voltages of between approximately 7 to 15 kilo-Volts which in most cases are acceptable from a design stand point. For example, for a two inch pleat depth composite filter material, and d1=0.5" with d2=0.625", the normal operating voltage for good ionization is 8 kilo-Volts, while spark discharge occurs to the control electrode at 10.5 kiloVolts. In another example, for a two inch pleat depth composite filter material, d1:1" while d2=1.25" with an applied voltage of 12 kilo-Volts, such that arcing occurs towards the control electrode at about 17 kilo-Volts.

With non-composite filter material (as in the second embodiment) a range for d1/d3 is between 0.45 to 0.95, but a more practical range is 0.5 to 0.7. A good value of d1 is between 0.375 to 1.5" with an applied field strength of about 4–7.5 kilo-Volts per centimeters. A specific example would be pleated filter material with a one inch pleat depth, with d1=1", and with d3=1.5", and d1/d3=0.66, high performance is achieved at an applied voltage of 12 kilo-Volts with sparking occurring towards the control electrode at about 17 kV. Another specific example would be a pleated filter material, with two inch pleat depth, d1=1.25", d3=2.25" to 2.33" and d1/d3=0.55, with an applied voltage, for high performance, of 15 kilo-Volts with sparking occurring at about 25 kilo-Volts towards the control electrode.

Table 2 illustrates with experimental results for the composite filter material, two inch pleat depth, d1=0.5" and d1/d2=0.8.

TABLE 2

CURRENT CHARACTERISTICS FOR AN 11" BY 11" DEVICE

| CONFIGURATION | CURRENT @ 8 kilo-volts | ARCING VOLTAGE | ARCS TO: |
|---|---|---|---|
| COMPLETE WITH BOTH GROUND ELECTRODES | 0.22 mA | 10.5 kilo-volts | CONTROL |
| NO CONTROL ELECTRODE | <0.05 mA | >32 kilo-volts | |
| NO DOWNSTREAM GROUND | <0.05 mA | 10.5 kilo-volts | CONTROL |

Note that without the control electrode the device approximates that disclosed in Jaisinghani '470, and produces no noticeable ionization, or current flow, at the relatively low amplitude of eight kilo-Volts applied potential. In other words, this embodiment achieves the desired ionization and electric field across the filter, at a relatively lower applied potential. The control electrode without the downstream electrode also produces very little current or ionization. The control electrode along with the downstream ground provides in a more "symmetrical" space charge density around the wires, thereby allowing controllable ionization in both directions at a reasonable potential. The control electrode also absorbs any over-voltage sparks.

Test Results for Filtering Devices Utilizing Composite Type and Single Dielectric Filter Material Since in most filtration applications an increase in filtration area is desired, the filter material is pleated. With the conductive carbon coated-glass paper composite filter material in a pleated form, as in a first electrode and filter portion of FIG. 1. The first configuration has 2" pleat depth, d1/d2=0.6 to 0.95, d1=0.375 to 1.25", d2=0.5 to 1.5", operating at 7 to 15 kilo-Volts applied voltage. As a specific example, a good design is d1/d2=0.8, d1=0.625, d2=0.75", and V=9 kilo-Volts. With the single dielectric medium configuration, a specific example of a good design for an one inch deep pleat depth is d1=1", d1/d3=0.66, d3=1.5" with an applied voltage of 12 kilo-Volts. Another highly effective single dielectric medium design is for two inch deep pleats, with d1=1.25, d3=2.25", d1/d3=0.55 at an applied voltage of 15 kilo-Volts. This design however, requires higher voltage (15 kilo-Volts).

For the first configuration, it is desirable to use a highly permeable (to air flow) carbon coated material as the conductive material 118 of FIG. 1 since the instant invention does not rely on the conductive material to provide a significant degree of filtration. The conductive material's main function is to provide a near ground potential uniformly throughout the composite filter material 114. Additionally, the conductive material should be thin so that the thickness of each pleat can be reduced, thereby enabling higher pleat density which increases the filter material's surface area. On the other hand, if VOC removal is desired, a thicker media results in a larger capacity for the removal of gaseous contaminants. A good balance of the two conflicting requirements is the utilization of a PET (polyester) or other polymeric felt material of 1/16" to ⅛" in thickness, with a basis weight of about two to eight ounces per square yard, coated with about 1.5 to approximately 10 ounces per square yard of activated carbon, to result in a Frazier permeability of at least 300 to 1000 scfm/ft$^2$ at 0.5" water column (WC) pressure drop (i.e. at least twice the permeability of the glass filter media). The carbon coated material used in the following examples is approximately 2.5 ounces of activated carbon per square yard with a Frazier permeability of about 650 scfm, and has a thickness of ⅛".

Figure 4A:
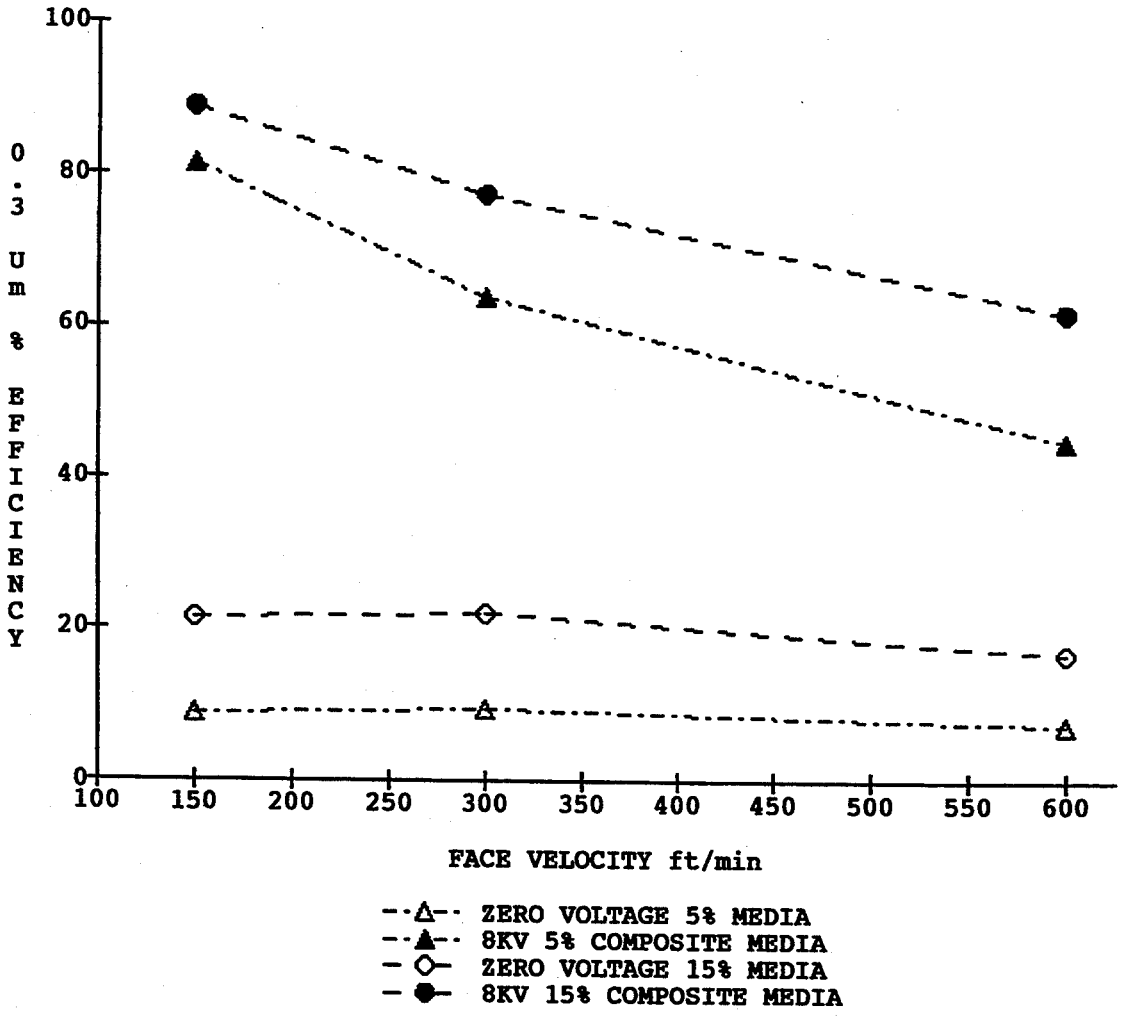
FIG. 4A is a graph of the efficiency enhancement of a two inch pleat dual media filter.
Figure 4B:
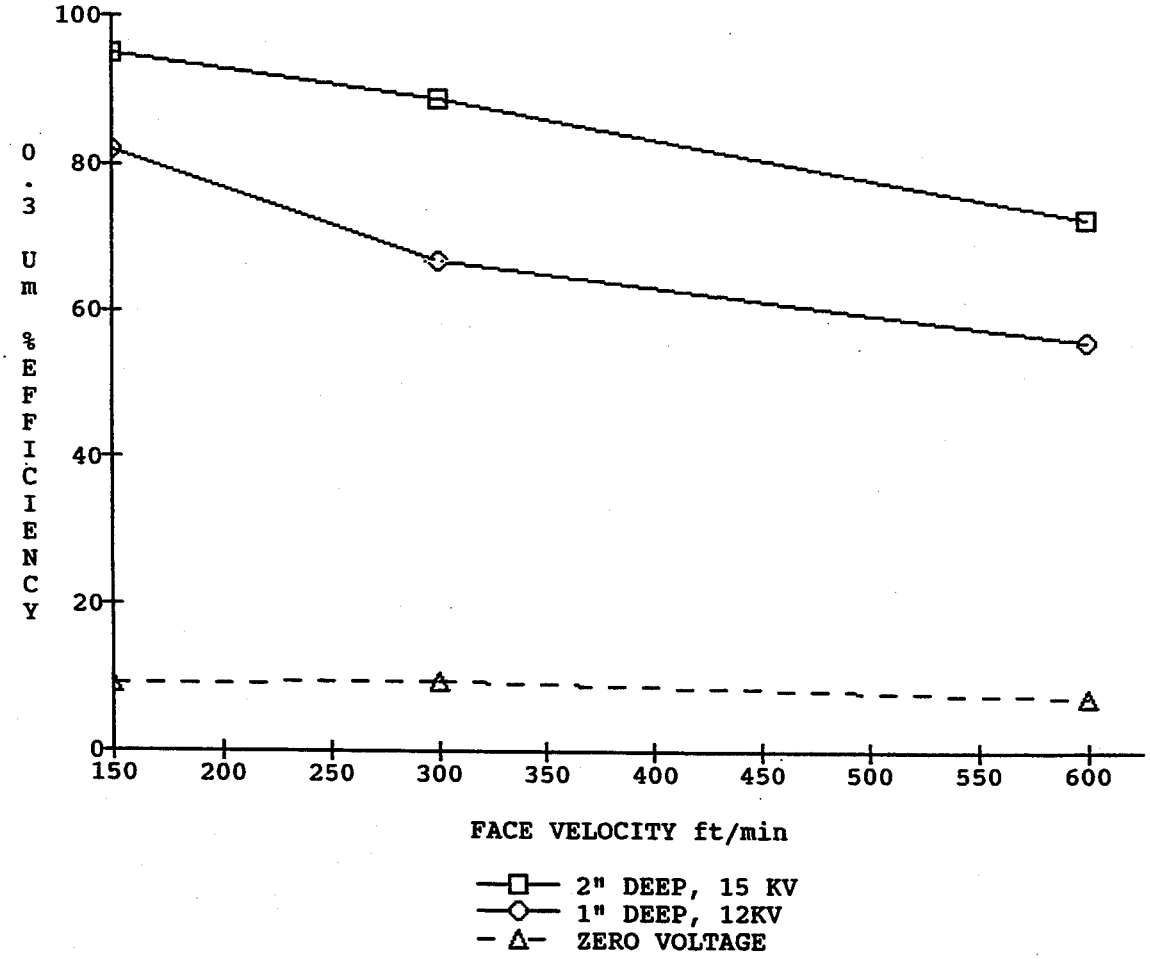
FIG. 4B is a graph of the efficiency enhancement of a two inch and one inch pleat single dielectric media filter.

The glass dielectric material to be used as the dielectric material 116 can be varied to suit the application. As shown in the graph presented by FIG. 4A, the single line marked by empty triangles represents zero voltage applied across with 5 percent media; the double line marked with solid triangles represents eight kilo-Volts applied across five percent composite media; the dotted line broken by empty arches represents zero voltage applied across fifteen percent composite media; while dashed line marked with solid circles represents eight kilo-Volts applied across fifteen percent composite media. In the examples, the composite media had d1=0.5" and d2=0.625. FIG. 4A shows the efficiency enhancement available at different velocities for two different glass dielectric material in two inch deep pleated form (with the activated carbon material). Note that eight kilo-Volts was applied to the wires in these examples. One of the glass media has a manufacturer's rating of 5% efficiency at 0.3 μm and a Frazier permeability of 251 scfm, while the second material has a rated efficiency of 15% @0.3 μm and a Frazier permeability of 160 scfm. Clearly, by varying the type of dielectric/-glass filter medium, different enhanced efficiency products can be created. Note that the efficiency enhancement is highest at the lower velocities. It should also be noted that this configuration results in good efficiency enhancement even at the extremely high face velocity (based on cross sectional area and not the material area) of 476 feet per minute. FIG. 4B shows the efficiency enhancement of the single medium configuration with 1" pleat depth, as described previously, at 12 kV and for the 2" deep previously described configuration operating at 15 kV, both using the 5% efficiency (at 0.3 μm) dielectric medium. In the examples illustrated by FIG. B, the single line marked by solid triangles represent twelve kilo-Volts applied across a single filter media having a one inch pleat depth (and with d1=1", d3=1.5"); and the single line masked by empty squares represents fifteen kilo-Volts applied across a single filter media having two inch deep pleats (and with d1=1.25", d3=2.25").

FIGS. 4A and 4B clearly illustrate the efficiency enhancement obtainable by the foregoing teachings which is evident by a comparison of the zero voltage curve to the 8 kilo-Volts curve (for dual media configuration d1/d2=0.8, d1=0.5", and V=8 kilo-Volts) and the zero voltage curve to the 12 kilo-Volt curve (single medium configuration d1/d3=0.66, d1=1", d2=1.5", and v=12 kilo-Volts) and the 15 kilo-Volt curve (single medium configuration, d1/d3=0.55, d1=1.25 and V=15 kilo-Volts). Additionally, the effectiveness of the method, as compared to conventional (no electrical enhancement) mechanical filtration is illustrated in TABLE 3 below.

TABLE 3A

| | COMPARISON TO CONVENTIONAL FILTRATION | | | |
|---|---|---|---|---|
| FILTER | VELOCITY ft/min | PRESSURE DROP "WC | EFFICIENCY % 0.3 micron eff | COMMENT |
| CONVENTIONAL | 238 | 0.17 | 5 | BASE EEF MEDIA |
| EEF (Dual Media) | 238 | 0.17 | 64.5 | HIGHER EFF LOWER PRESS |
| CONVENTIONAL | 238 | 0.80 | 52.5 | LOWER EFF HIGHER PRESS |
| CONVENTIONAL | 238 | 0.42 | 53.5 | 2X MORE MEDIA |
| EEF | 400 | 0.36 | 53 | HIGHER FLOW |
| CONVENTIONAL | 400 | 1.88 | 55.5 | HIGH PRESS |
| CONVENTIONAL | 79 | 0.18 | 55 | SAME PRESS DP LOW FLOW |
| CONVENTIONAL | 100 | 0.20 | 55 | 2X MORE MEDIA |
| CONVENTIONAL | 162 | 0.42 | 52.5 | LOW FLOW |

TABLE 3B

| FILTER | VELOCITY ft/min | PRESSURE DROP "WC | EFFICIENCY % 0.3 micron eff | COMMENT |
|---|---|---|---|---|
| BASE FILTER 1 | 238* | 0.09 | 5 | CONVENTIONAL |
| EEF (USING ABOVE) | 238* | 0.09 | 92 | HIGHER EFF LOWER PRESS |
| BASE FILTER 2 | 238* | 0.19 | 52.5 | LOWER EFF HIGHER PRESS |
| EEF (BASE FLT 1) | 400** | 0.15 | 82 | HIGHER FLOW |
| BASE FILTER 2 | 400** | 0.36 | 55.5 | HIGH PRESS |
| BASE FILTER 2 | 240** | 0.17 | 55 | SAME PRESS DP LOW FLOW |

*Tremendously higher efficiency at same velocity as compared to same media based conventional and higher efficiency and lower pressure drop even when compared to the second higher efficiency (base 2) conventional filter.
**Higher flow and lower pressure drop at significantly higher efficiency than base filter 2.

The results in Table 3A were based on an electrically enhanced filter (EEF) in a duct type configuration (see FIG. 10) with the first composite filter combination using the 5% rated dielectric-glass filter media with 2" pleats, at a pleat density of 1.6 per inch (keeping in mind that with this media combination a maximum pleat density of about 2.5 is possible), d1/d2=0.8, d1=0.5", and V=8 kilo-Volt. This result should be compared to the conventional filters with the same pleat density and with twice the pleat density or media area. The electrically enhanced filter has a higher flow at similar pressure drop and higher efficiency than the conventional filter, and a lower pressure drop and significantly higher efficiency at the similar velocity, even when compared to the conventional filter with twice as much media. These advantages over conventional filtration as used as follows:

First, two to three times higher flow rate at the same pressure drop as conventional filtration is achieved; additionally, the efficiency may also be higher depending on the particular base material efficiency and flow rate.

Second, a lower pressure drop results at the same flow rates as conventional filtration, even at the same or at a higher efficiency. This also results in a significantly higher life or contaminant capacity.

Third, and finally, a significantly higher efficiency is obtainable than with a conventional filter operating at the same flow rates and pressure drop. This also results in significantly higher life or contaminant capacity.

Typically, a highly permeable, low mechanical efficiency material is electrically enhanced to result in a significantly higher efficiency. The end result is a high efficiency filter with extremely low pressure drop, and/or a two to three times higher flow rate (as compared to a conventional or mechanical filter). Lower noise indoor air cleaners can be produced by using low noise fans instead of blowers by taking advantage of the low pressure drop of the electrostatically stimulated filtration. Additionally, smaller size filters can be made, or alternatively, the throughput of existing packages can be increased. Similar advantages are obtained using the second embodiment of the filter and electrode portion (single dielectric medium) in pleated form, as shown in Table 3B. The results in Table 3B are based on a single dielectric medium (base mechanical efficiency of 5%) electrically enhanced filter, with two inch deep pleats at a pleat density of about 6 pleats per inch, d1/d3=0.555, d1=1.25", d3=2.25" and an applied voltage V=15 kilo-Volts. Similar advantages are obtained for other pleat depths and ranges of V/d1 and d1/d3 (for the single dielectric medium) or d1/d2 (for the composite medium) specified in the previous sections.

In order to demonstrate the safety aspects of the invention, water and conductive carbon dust was fed into the intake of the two inch deep pleated composite media configuration with d1=0.5" and d2=0.625" and a filter cross section of 11"×11", operating at 8 kilo-Volts, and into the intake of the 2" deep single medium configuration with d1=1.25", d3=2.25", filter cross section of 11"×11", operating at 15 kilo-Volts.

TABLE 4A shows the environmental safety results for the composite medium configuration, while Table 4B shows the results for the single medium configuration

TABLE 4A

| ENVIRONMENTAL TESTS | | |
|---|---|---|
| CONTAMINANT | AMOUNT ADDED | RESULT |
| WATER | 1 pint | no change in current |

TABLE 4A-continued

| ENVIRONMENTAL TESTS | | |
|---|---|---|
| CONTAMINANT | AMOUNT ADDED | RESULT |
| WATER | 2 pints | current increases from 0.2 to 1 ma and decreases as water evaporates |
| WATER | 7 pints in 1 pint increments | same as above |
| CARBON | 3.14 g | slight increase in current no arcing |
| CARBON | 7.21 g | current increases steadily |
| CARBON | 20.07 g | to the current limited value of 1 mA - no arcing |

Consider, first the composite media configuration (Table 4A). After each addition the arcing voltage was also measured. For the composite media configuration, the arcing voltage was unchanged from the value of the clean filter—10.5 kilo-Volts. The arcing was always observed to be towards the control ground electrode. This environmental testing was done under extremely harsh conditions using a large amount of water aerosol and 100% carbon (conductive) dust. Under no circumstance did any arcing occur toward the filter (with the power supply limited at 1 mA per square foot of cross sectional area) occur. When the voltage was increased to a higher than normal (8 kV) level the arcing was toward the control electrode only. Other forms of ESF (e.g., Jaisinghani and Bugli (1988)) produce spark discharge towards the filter medium immediately when 100% carbon dust is injected. Thus the advantages of the control electrode are clearly demonstrated. It should be noted that as a result of feeding the 20 grams of carbon dust the pressure drop increased nine fold over the clean value of 0.1" WC. This range of operation is far greater than used in practical situations. In practice the filter element would be replaced significantly earlier so that the device would not have to resist the accumulation of this high amount of conductive contaminant. This extremely harsh test however, is useful in illustrating the effectiveness of the safety aspects of the invention.

Consider now the case of the single dielectric medium configuration (Table 4B).

TABLE 4B

| CARBON FED g | CURRENT mA | PRESSURE DROP "WC | COMMENT |
|---|---|---|---|
| 0 | 0.1 | 0.4 | clean element arcs @ 27 Kv towards control |
| 2 | 0.1 | 0.54 | |
| 4 | 0.3 | 0.8 | |
| 6 | 0.5 | 1.12 | arcs @ 23 Kv towards control |
| 8 | 0.7 | 1.64 | arcs @ 20 Kv towards control |

Referring to Table 4B, fine carbon dust was fed into the single medium configuration element until the pressure drop increased four fold from an initial value of 0.4" WC to 1.6" WC. This is the maximum expected operating range of in most HVAC air cleaning applications. The current requirement of the filter was within the practical limit of the power supply (1 mA for the small size of the filter). Within this practical operating range there was no sparking observed towards the filter—keeping in mind that this was a very harsh test using highly conductive carbon dust. No sparking towards the filter was observed when a water aerosol was fed into the filter. At periodical intervals the voltage was increased until spark discharge (Table 4B). While the value of the sparking voltage decreased with increasing amounts of carbon fed, the observed spark was always towards the control electrode, in this range of operation. This demonstrates the safety aspects of the control electrode using the single medium configurations.

Housing Embodiments

Figure 5A:
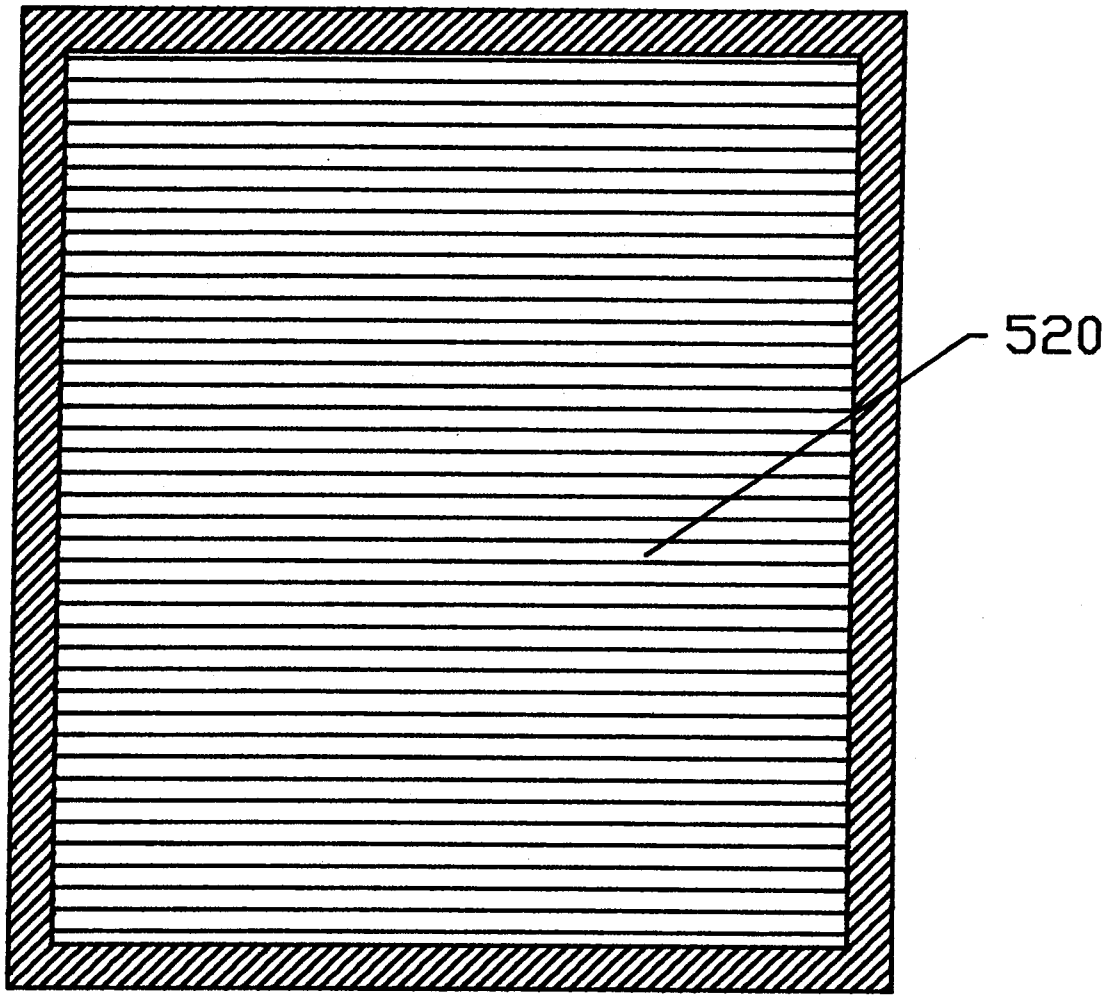
FIG. 5A is a front view of a second embodiment of the housing.
Figure 5B:
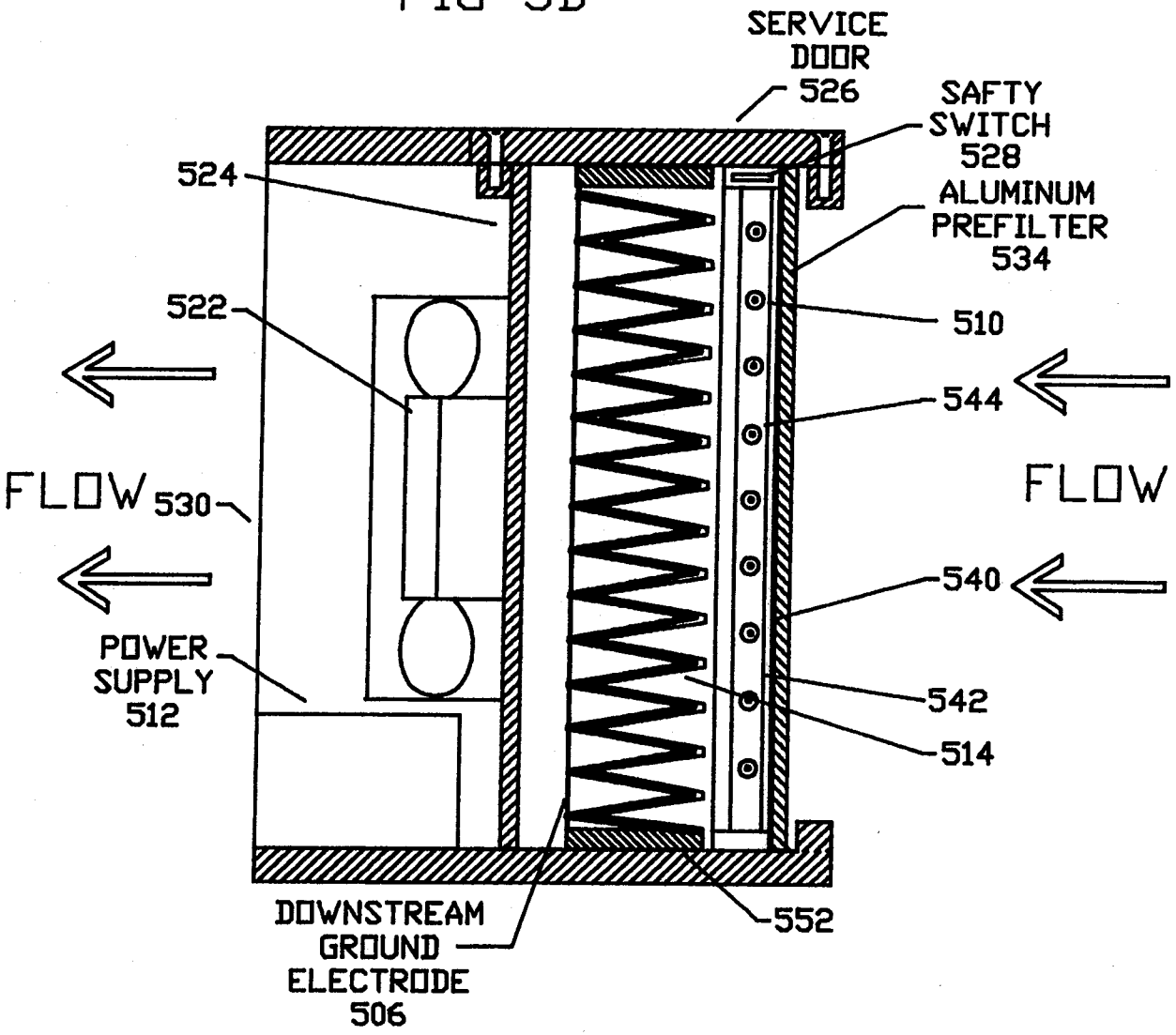
FIG. 5B is a cross-sectional view of the second embodiment of the housing with pleated filter material.
Figure 5C:
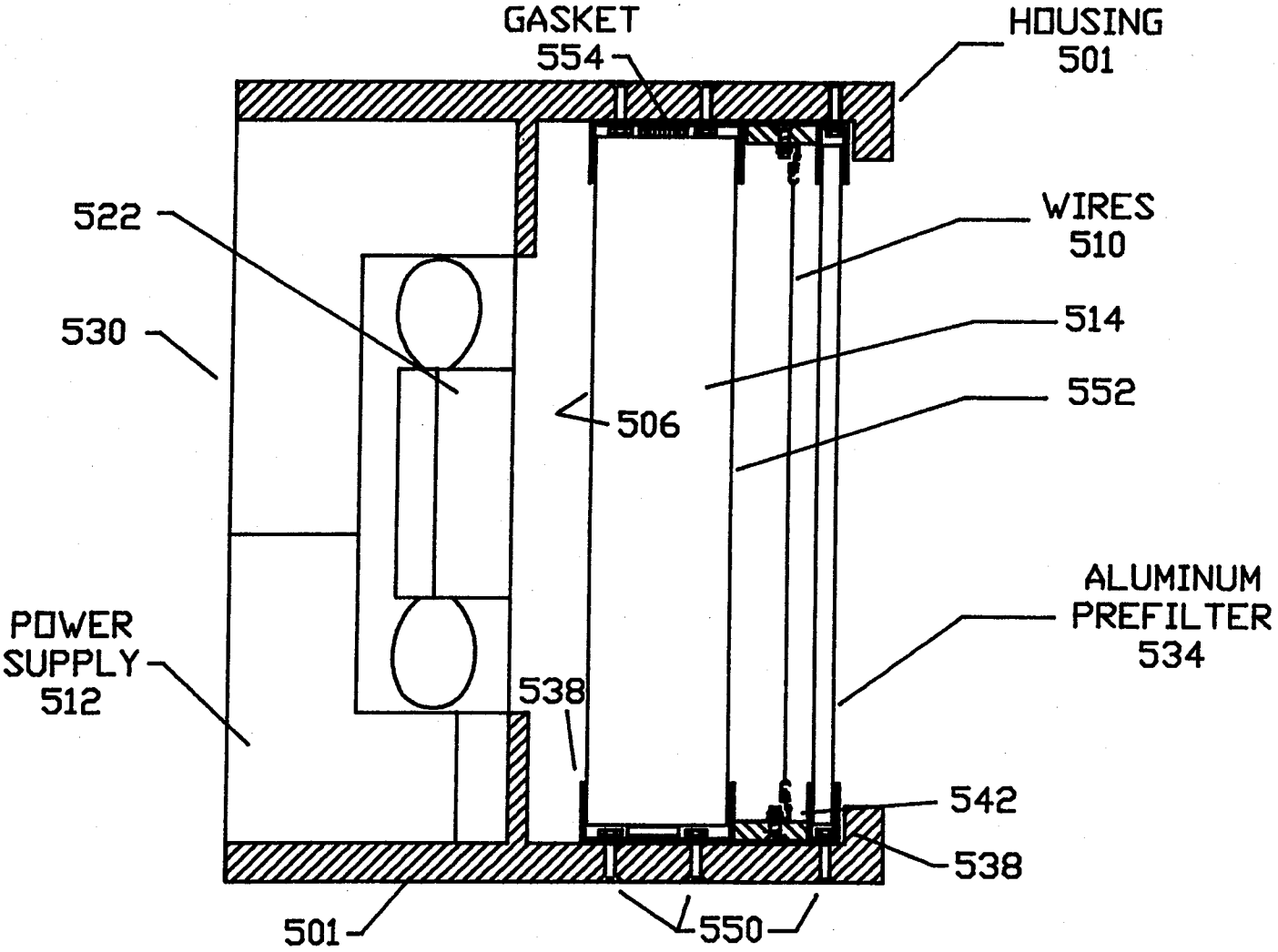
FIG. 5C is a top cross-sectional view of second embodiment of the housing.

Three alternative embodiments of the electrostatically stimulated filtration housing are disclosed. A first embodiment is illustrated in FIGS. 3A–3F. A second embodiment is illustrated in FIGS. 5A, 5B, and 5C. A third embodiment is illustrated in FIGS. 7A–7F. The first embodiment is a free standing portable device. The second embodiment is a straight through flow type unit. The third embodiment is an example of a unit that can be installed in the HVAC system of a commercial/industrial or other indoor air supply. Other configurations are easily designed using the same design concepts presented in the following three configurations.

Figure 3A:
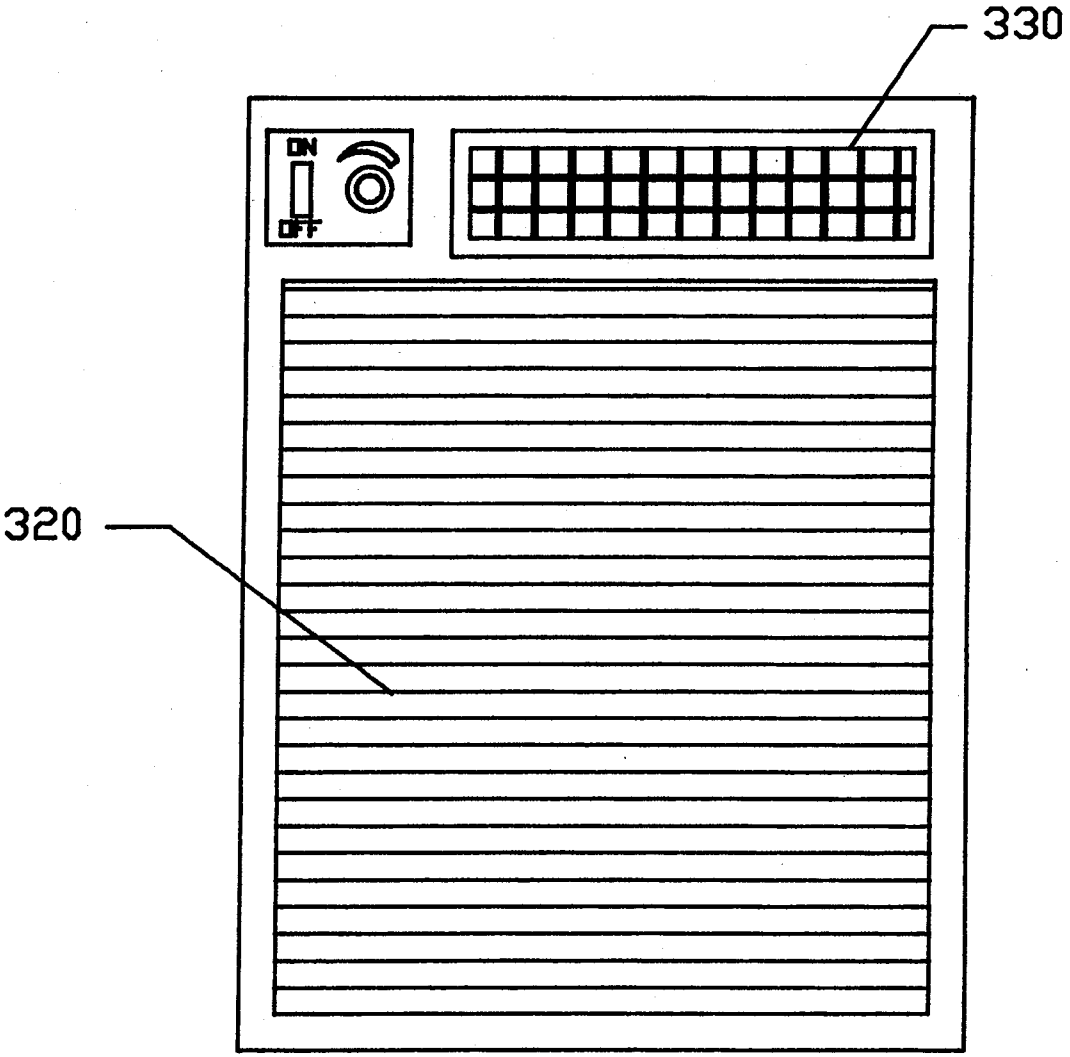
FIG. 3A is a front view of a first embodiment of a housing of the electrostatically stimulated filtering device.
Figure 3B:
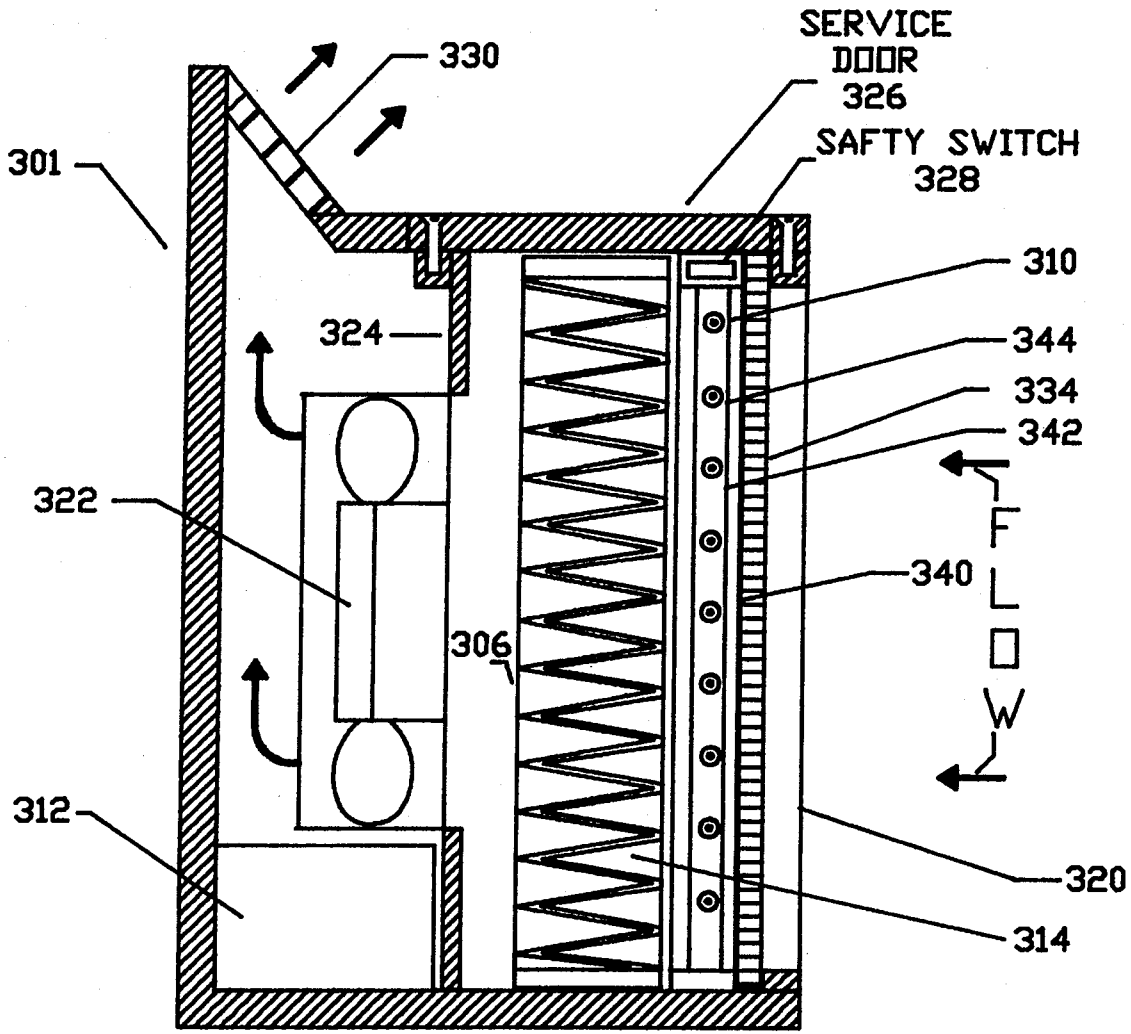
FIG. 3B is a side cross-sectional view of the first embodiment of the housing.
Figure 3C:
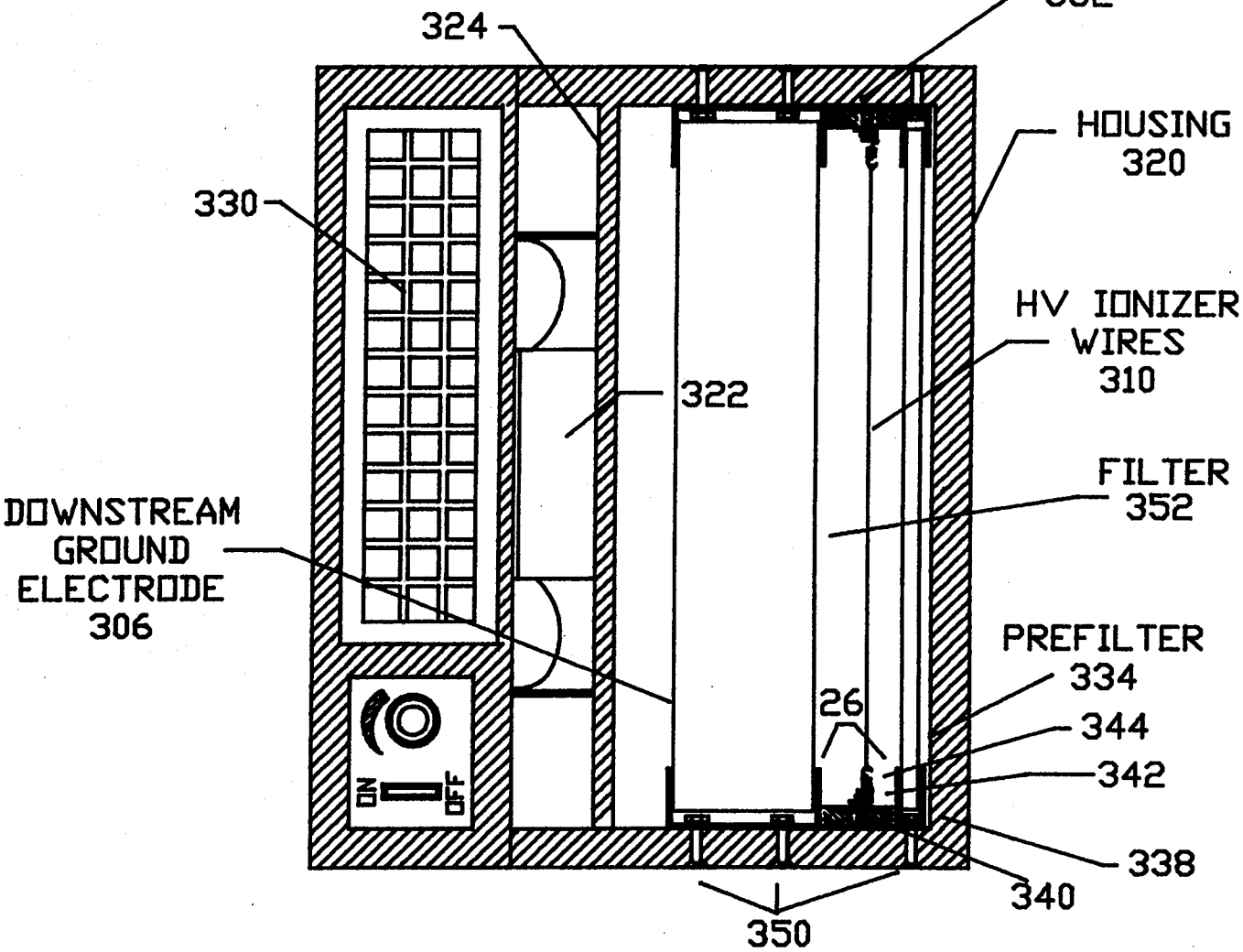
FIG. 3C is a top partial cross-sectional view of the first embodiment of the housing.

FIG. 3A is a front view of the first embodiment. The air intake grill 320 receives air to be filtered which is then expelled through air exit grill 330. In this embodiment the air flow changes direction so that the clean air is blown upward. FIG. 3B is a side cut-away view of the first embodiment showing: fan/blower 322, an internal plate 324 supporting the fan/blower. The internal plate 324 has a cut-out portion through which air is drawn. A high voltage power supply 312 is mounted, preferably, on the clean air side and within the air flow, so that it can be cooled without additional cooling devices or without requiring extra heat dissipation components. A filter replacement service door 326 sealably joins the housing 301. A safety switch 328 cuts off all electrical power to the unit (fan and high voltage power supply) if service door 326 is removed or opened.

A downstream ground electrode 306, ionizing wires 310, and composite filter material 314 are the same as similar elements described previously with reference to FIG. 1. One modification which differs from FIG. 1 is the utilization of a metal mesh prefilter 334, such as those used in many other high voltage air conditioning (i.e., HVAC) applications, as the control electrode 104 in FIG. 1. In the case of FIG. 3A–3F, d1 is the distance between the downstream side of the metal prefilter 334 and the high voltage ionizing wires 310. One advantage of this refinement is that the prefilter 334, already required in many applications, is made to perform an additional function of the control ground electrode.

Figure 3D:
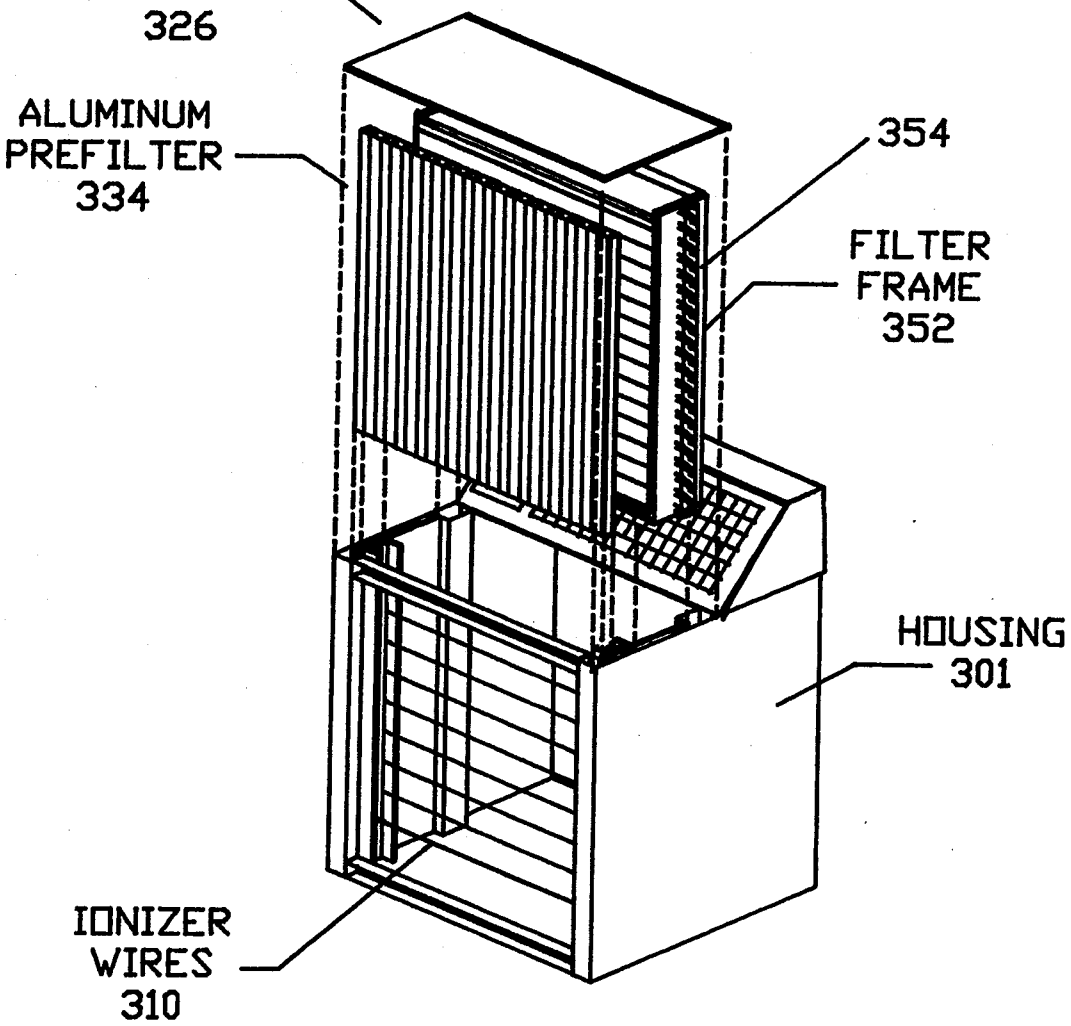
FIG. 3D is an elevational view of the first embodiment of the housing with the filter material and a profilter partially removed.
Figure 3E:
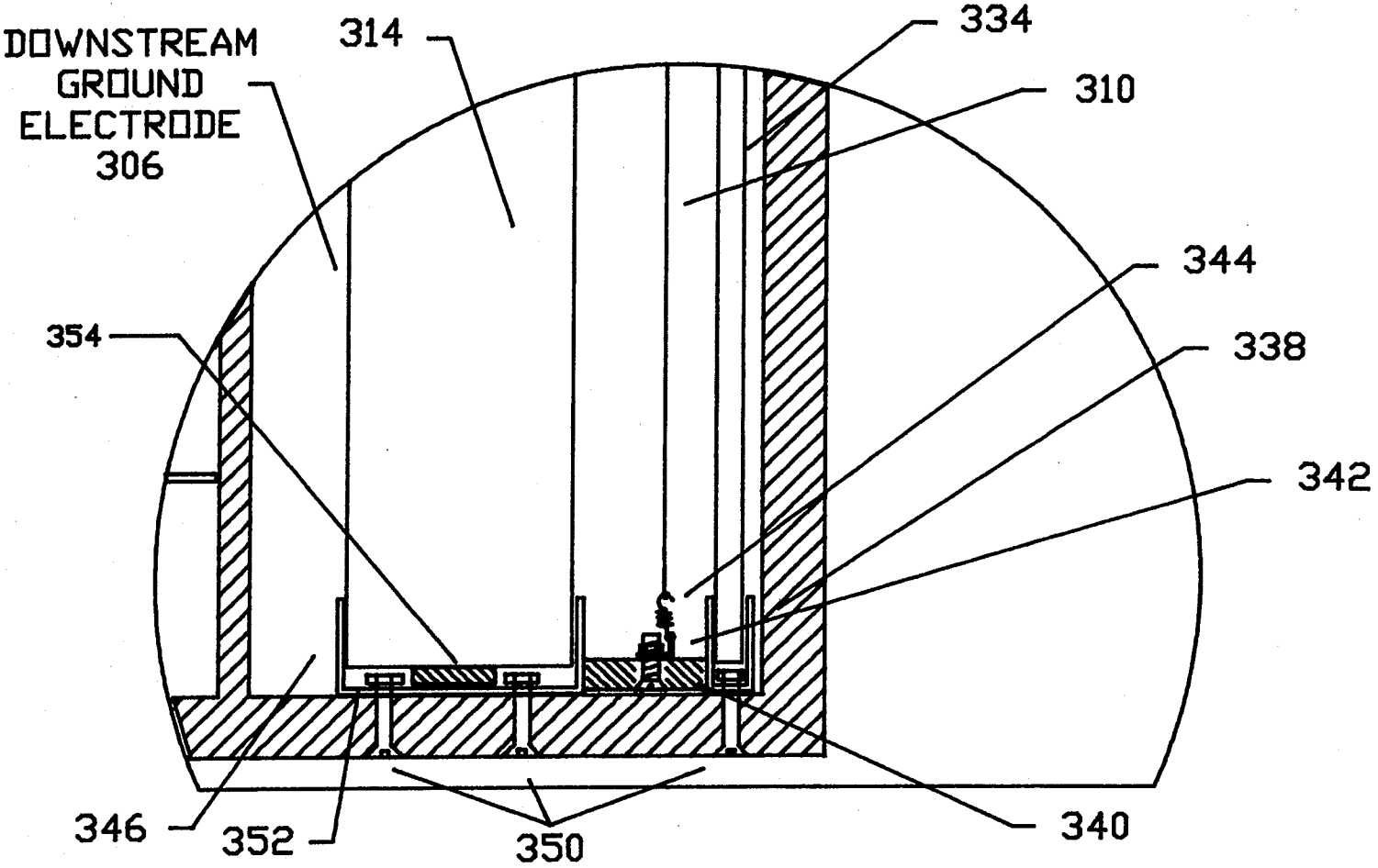
FIG. 3E is an enlarged top cross-sectional view of the first embodiment of the housing.
Figure 3F:
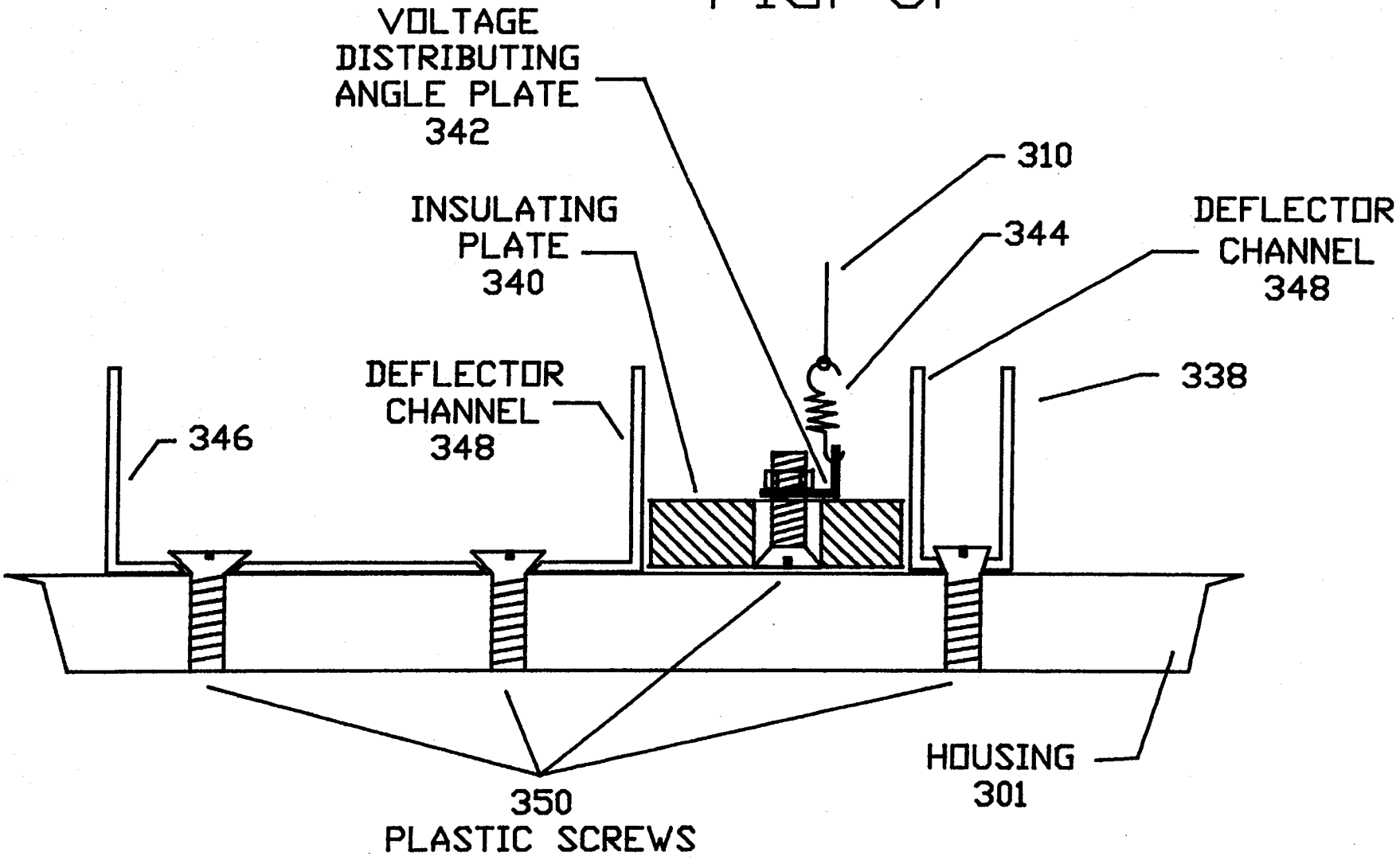
FIG. 3F is an enlarged top cross-sectional view of the first embodiment of the filter and electrode portion with the filter material removed.

Referring now to FIGS. 3C–3F, FIG. 3C shows an overhead partial cut-away view of the first embodiment of the housing 301 additionally illustrating the support assembly 332 for the filter and electrode portion. FIG. 3E is detailed cut-away view of the support assembly 332 with the filter material 314 and prefilter 334 disposed therein. FIG. 3F is a detailed cut-away view of the support assembly 332 the filter material and prefilter removed. In FIGS. 3C–3F, the support assembly 332 and filter and electrode portion incorporate: a prefilter holding assembly, typically a prefilter C channel 338; an ionizer assembly comprising a ceramic or acrylic insulating plate 340; a metal conductive angle plate 342 for distributing the high voltage to the ionizing wires 310; springs 344 keep the ionizing wires 310 under slight tension; a filter C channel 346 for supporting the filter material; a deflector channel 348 comprised of legs of the C channels 338, 346 that both shields the metal voltage distribution angle plate 342 and the springs 344 from any ground potential while deflecting air flow away from the insulating plate 340; and plastic screws 350 secure the C channels 338, 346 to the housing 301. It is essential that the screws for mounting the insulating plate 340 and the angle plate 342 be non conductive and have a high dielectric strength.

The utilization of the C channels 338, 346 as deflectors is a cost effective method for deflecting the flow since no special deflector channel is required. Deflection of the flow keeps the surfaces of insulating plate 340 clean, thus preventing arc tracks from developing. The height of the C channels 338, 346 are at least equal to the height of the insulator 23 and the springs 25 so as to prevent arcing from the springs to ground. It is important to note that the only ground potential surface facing the ionizing wires 310 is the prefilter/control electrode 334, although the downstream ground electrode 306 also affects the electric fields since it is covered by a porous dielectric. All other conductive surfaces of the housing 301, within the two ground electrodes must be shielded by the insulating plate 340 and the two non-conductive C channels 338, 346; any other exposed surfaces must be covered with insulating material or plastic tape. Not only does this coverage eliminate the potential of arcing to these surfaces, but this insulation method also reduces leakage current through the housing 301.

Referring now to FIG. 3E, illustrating the filter and electrode portion with the filter material 314 and profilter 334 inserted therein, filter material 314 housed in a filter frame 352 is slidably inserted in the filter C channel 346. A soft seal gasket 354 prevents air flow around the filter frame 352. If a high efficiency glass filter is used, then another traditional gasket scaling method with sealing turn down screws may be used instead of the friction seal achieved by sliding the filter frame 352 within the filter C channel 346. For the 5% glass filter material used, this method is sufficient, keeping in mind that the air flow tends to press the filter frame 352 against the filter C channel 346, thus improving the friction seal. Prefilter 334 is slidably inserted into the prefilter C channel 338.

FIG. 3D illustrates the first embodiment of the housing with the filter material 314, the prefilter 334, and the filter replacement service door 326 removed from the housing 301. Also illustrated in the filter frame 352 for supporting the filter material 314. It may be noted that internal plate 324, blower fan 322, power supply 312 and safety switch 328 are not shown in FIG. 3D.

The second embodiment of the housing illustrated in FIGS. 5A, 5B and 5C incorporates components similar to those described with reference to the first embodiment of the housing, like elements having reference numerals with the same ones and tens digits. Air enters the unit through air intake grill 520 and exits through an air exit grill 530. In view of the similarities to the second embodiment, added description will not be provided. The second embodiment of the housing differs to the extent that the air flows straight through the unit. This second embodiment may be used without a fan for HVAC system filtration applications.

Figure 7A:
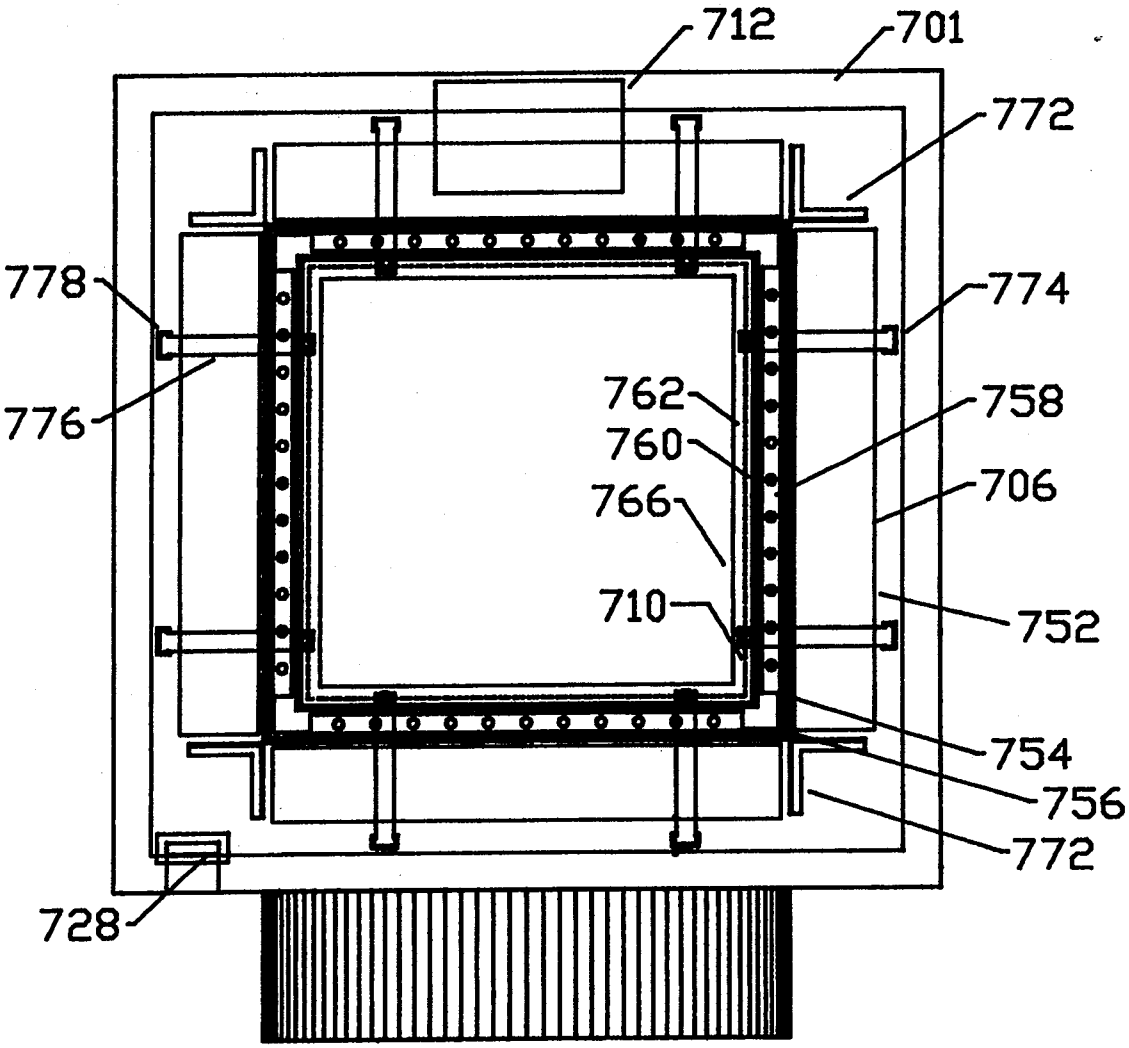
FIG. 7A is a top cross-sectional view of a third embodiment of the housing that maximizes filter area for a given duct area.
Figure 7B:
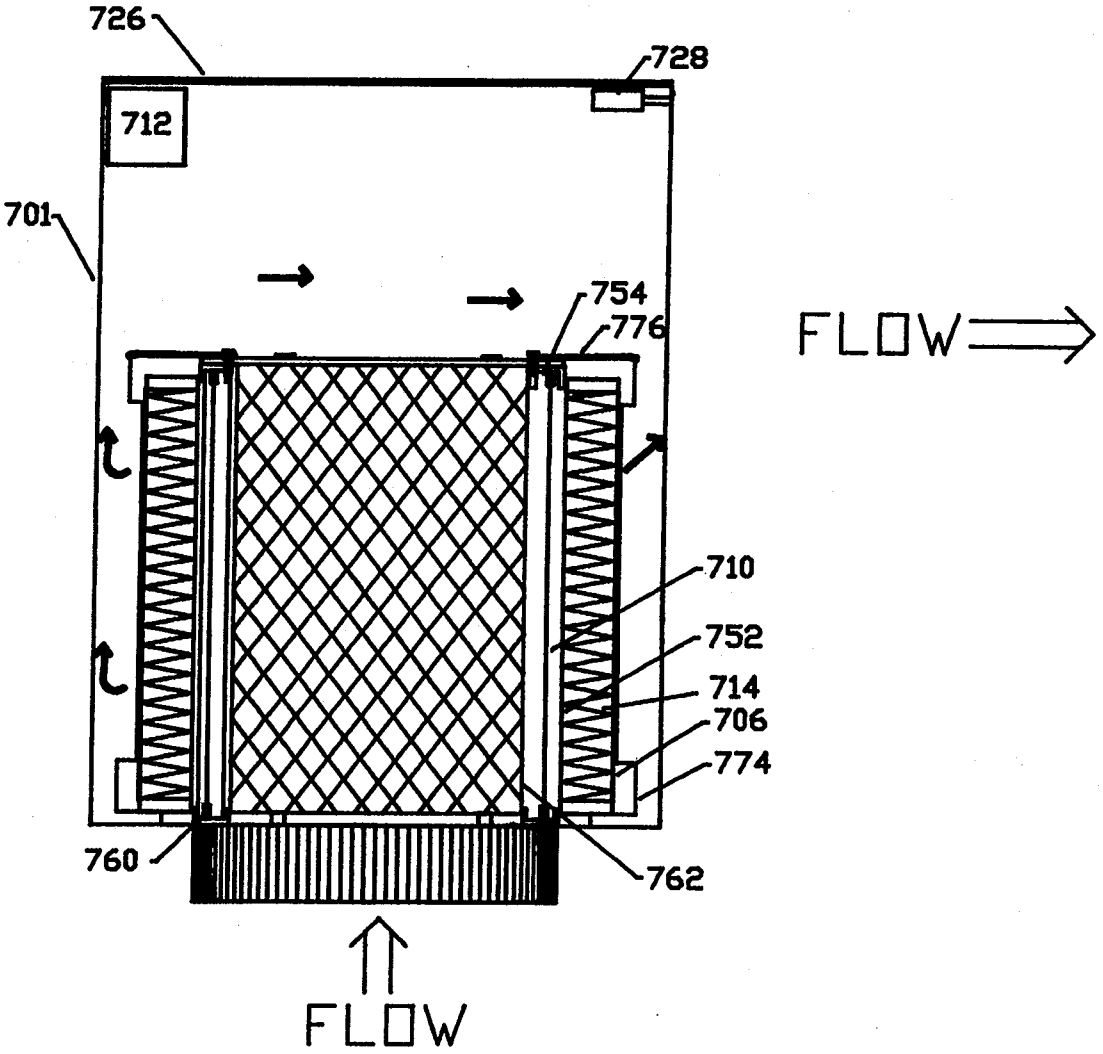
FIG. 7B is a front cross-sectional view of the third embodiment of the housing.

FIG. 7A–7E illustrate the third embodiment of the housing which is specifically designed for a commercial/industrial HVAC application where the air is driven by the HVAC fan (external to the embodiment). Conversely, a fan may also be added at the air exit so that the housing may be used in other air cleaning applications. The housing 701 is installed, typically to a duct that is on the inlet side of the heating and cooling coils of the HVAC unit. FIG. 7B shows the dirty air entering on the bottom or one side of the housing 701 and exiting at right angles to the entry direction, note that other combinations of inlet and outlet arc possible. The service door 726 (for changing filter elements) is on the opposite face of the inlet and sealably attached to the housing 701. A safety switch 728 is attached to the housing 701 in such a manner such that if the service door 726 is opened, all electrical power to the unit is cut off. The high voltage power supply 712 is attached as shown in FIG. 7A and 7B on the clean air side. It may be noted that prefilter 766 is not shown in FIG. 7B.

Figure 7C:
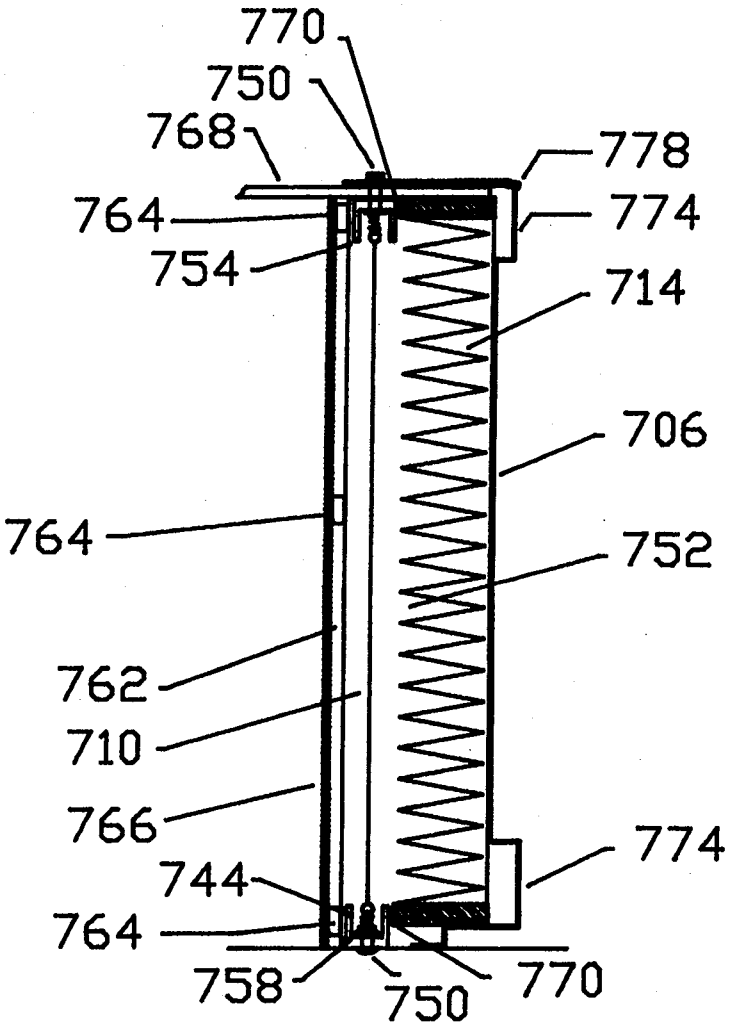
FIG. 7C is a front cross-sectional view detailing a third embodiment of the filter and electrode portion for the third embodiment of the housing.
Figure 7D:
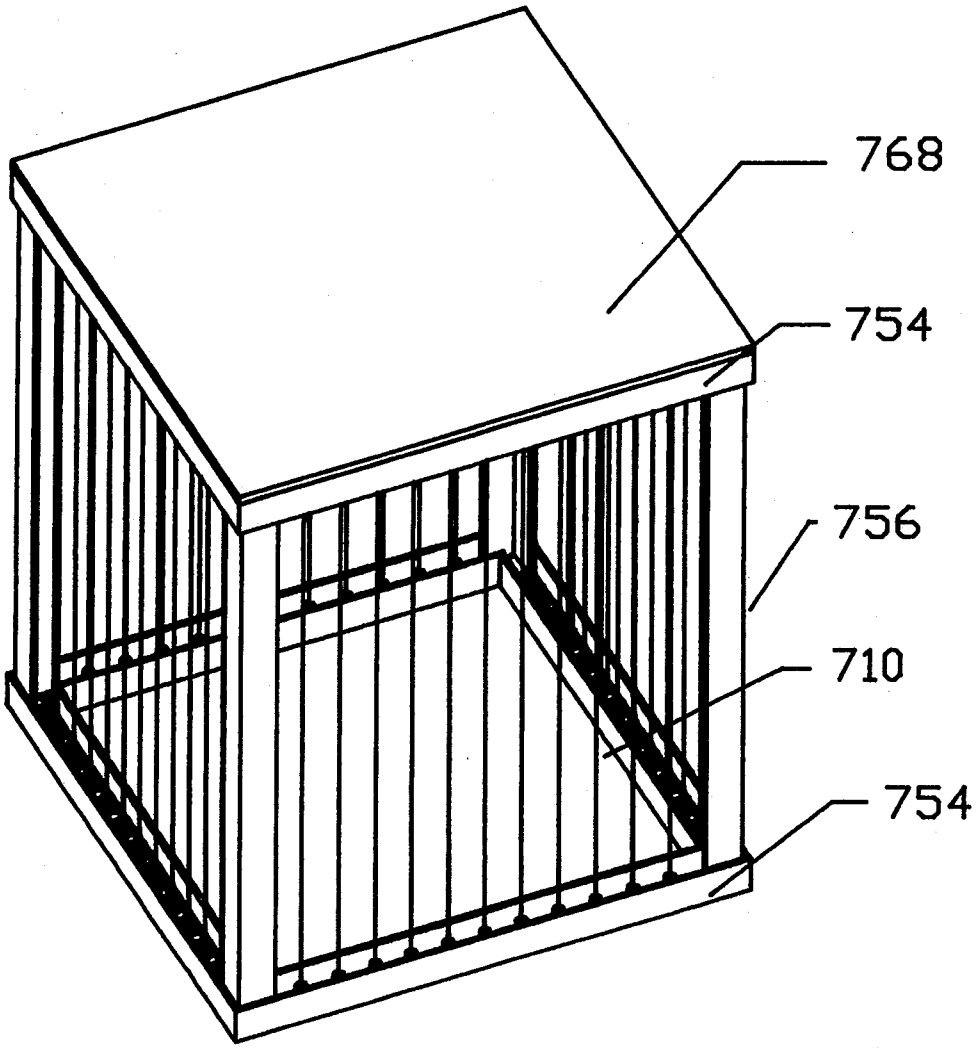
FIG. 7D is a three dimensional view of an ionizer assembly used in the third embodiment of the housing.

This third embodiment utilizes a four sided filter and electrode portion as shown in Figs. 7A–7D. This allows for the processing of large amounts of air with a ultra low pressure drop in a compact volume. The HVAC application requires this capability. Additionally, the four sided filter provides a high amount of filter media area, necessary for air filtration applications having high concentrations of dust and other contaminants. The four sided ionizer 760 is made using a high dielectric strength material (e.g., acrylic or other plastic composites) C section channel 754 along with plastic vertical support angle members 756 to create a frame that is open on all four sides as shown in FIG. 7D. The ionizer electrode wires 710 are attached to a conductive voltage distribution plate 758 using the springs 744, and the plate 758 is attached to the C section channel 754 by means of non-conducting plastic screws or fasteners 750. The high voltage power supply 712 is connected to the distribution plates 758 in order to energize the ionizing wires 710. Note that the height of the C section channel 754 is such that it effectively shields the springs 744 as discussed in descriptions of the previous embodiments. The ionizer assembly 760, is attached to the bottom of the housing 701, centered around the inlet such that all the air flows through it.

The C section channel 754 is such that by attaching four permeable control electrode grids 762, which serve as control electrodes, to an inside or upstream surface of the C channel 754 the desired value of d1 is obtained. These control electrode grids 762 are grounded so as to function as the control electrode described in reference to FIG. 1. "Velcro" or similar self-adhering strips 764 are attached to the inside or upstream side of the control electrodes 762 in a periodic manner as illustrated in FIG. 7C. This permits the attachment of a coarse low restriction pre-filter material 766 (with corresponding self adhering strips 764) on all four inside surfaces of the ionizer assembly 760. The pre-filter material 766 can be replaced by detaching the ionizer cover 768 which is normally attached to the top of the ionizer assembly 760 such that no air can flow out from the top and such that all the air must flow through the sides of the ionizer assembly 760 as shown in FIG. 7B.

Figure 7E:
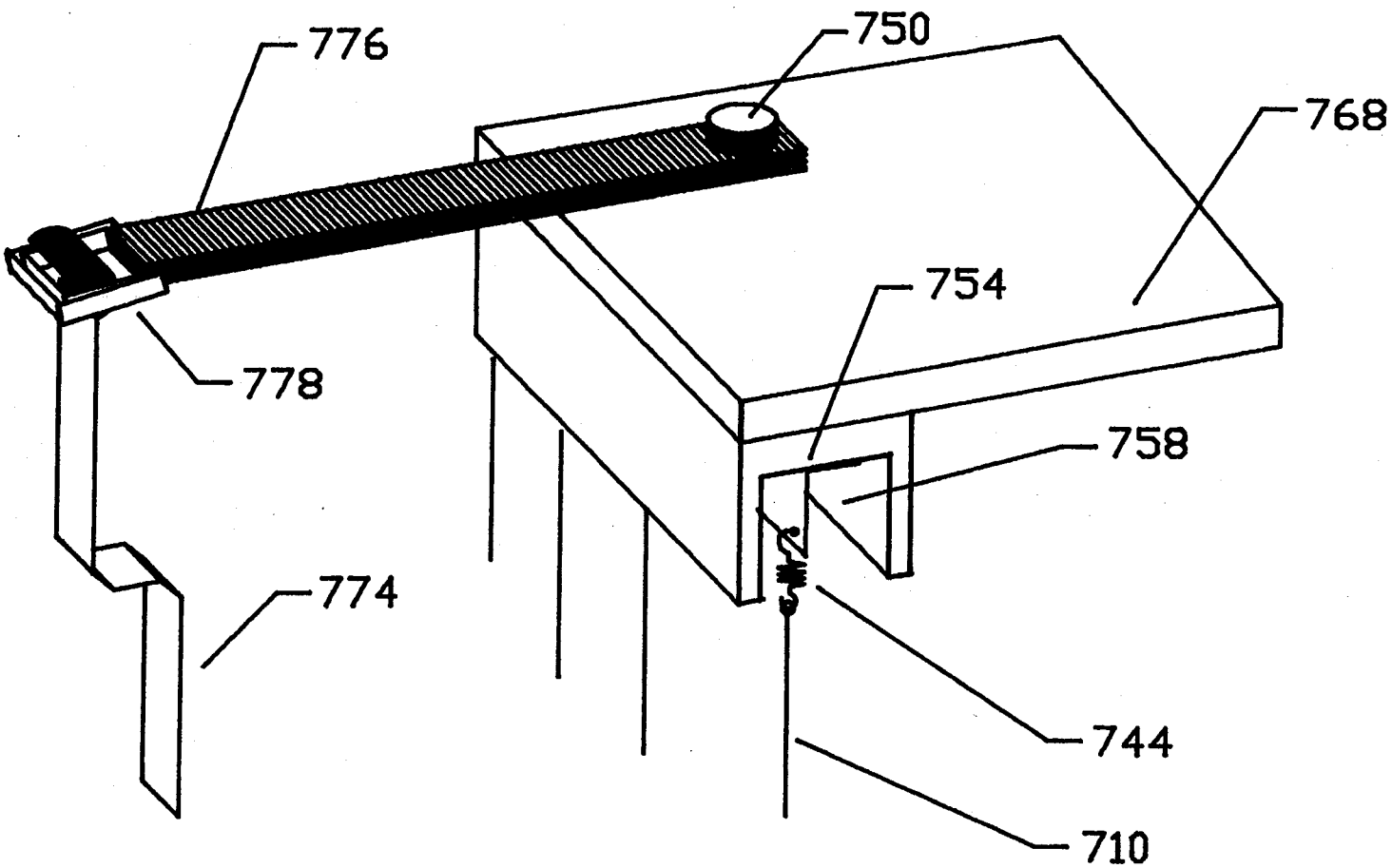
FIG. 7E is a detailed view of a filter sealing mechanism used in the third embodiment of the housing.

The filter frame 752 which holds the filter material 714 is mounted against the outer fiat surfaces of the C channel sections 762 of the ionizer assembly 760 as shown in FIG. 7A and 7C, such that the only path for the air is to flow through the filter material 714. The filter frame 752 has a compressible seal gasket 770 mounted on the influent lip of the frame. Angle guides 772 attached to the base of the housing 701 (FIG. 7A) serve to align the filter frames 752 in their proper positions upon insertion. Each filter frame 752 is held against the ionizer assembly 760 face by means of two filter hold down mechanisms shown in FIGS. 7E and 7C in detail. This mechanism has (i) a metal strip/filter retainer 774 bent inwardly towards the downstream ground electrode 706, which is integrated into the filter frame 752, (ii) a plastic strap 776 attached to the ionizer assembly cover 768 and (iii) a buckle 778 attached to the end of the plastic strap 776 such that it can pull the retainer 774 inward against the downstream electrode 706 of the filter frame 752. The net result is that the filter seal gasket 770 is compressed against the ionizer assembly 760 such that the desired gap d2 or d3 is obtained. The metal strip filter retainer 774 serves not only to seal the filter frame 752 against the ionizer assembly 760, but also to provide the ground connection to the downstream electrode 706 which is integrated into the filter frame 752. The filter elements or frames are easily replaced by opening the service door 726 and unhooking the straps 776 in order to pull out the filters. Neither filter frame 752, filter material 714, control ground 762 nor prefilter 766 are shown in FIG. 7E.

Description of Preferred Embodiment of Filter Element/Frame

Figure 8A:
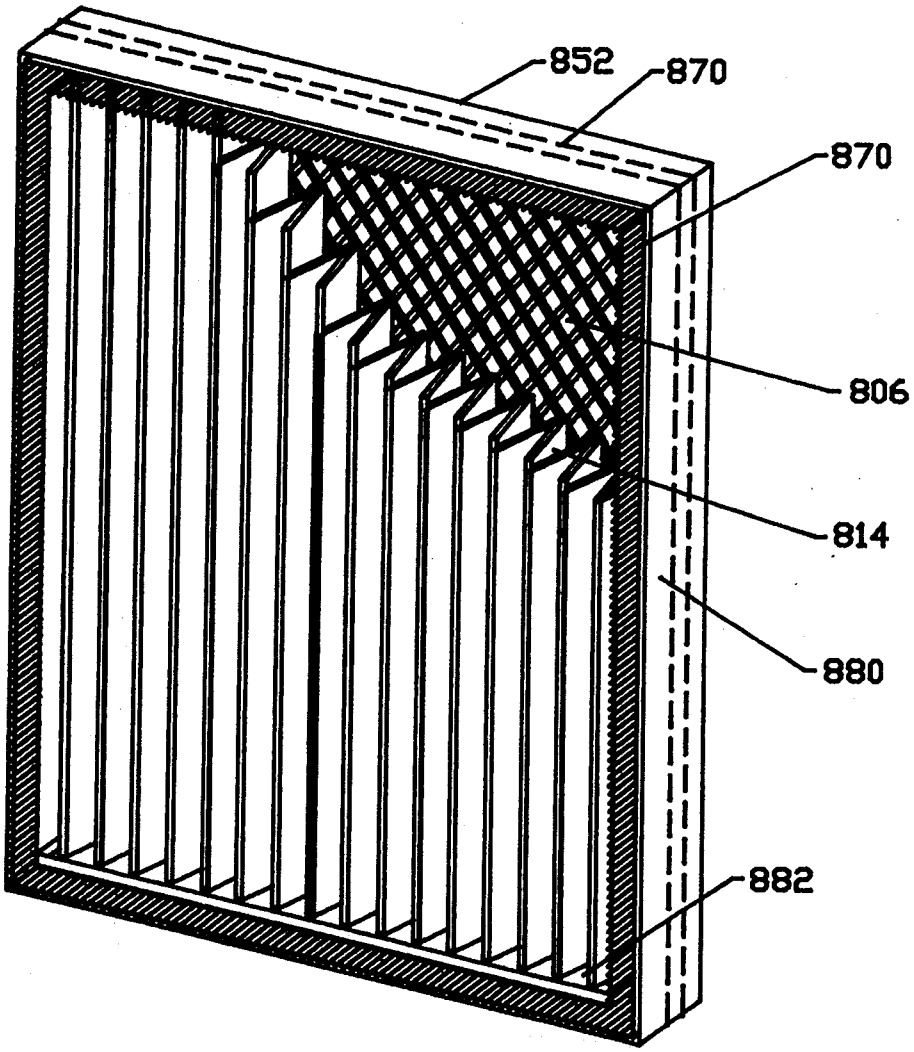
FIG. 8A is a detailed view of a filter frame.
Figure 8B:
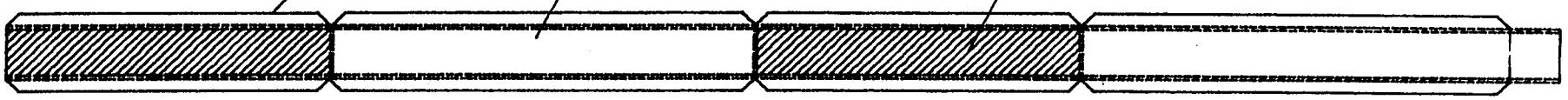
FIG. 8B is another view of the filter frame.

FIGS. 8A and 8B illustrate a filter frame 852 which is compatible with all three embodiments of the housing described above. FIG. 8A is a partial cross section and a 3D view of the filter frame 852 and the other components of the filter element. Taking advantage of the relatively low voltage used in this invention and since high voltage is not applied directly to the filter element, the preferred embodiment of the filter frame 852 is made of cardboard or fiberboard as shown in FIG. 8B or other resinated or laminated paper sheet with or without a flame retardant coating. This is a highly economical method of constructing a filter frame. Since the downstream perforated metal ground electrode 806 is incorporated within the filter frame 852 (FIG. 8A), the filter clement has adequate structural strength in spite of the corrugated cardboard used. Further, the cardboard can be easily die cut with partial folding cuts in order to form a singular piece that can be folded over the pleated filter material 814 (FIG. 8A, 8B) and the ground electrode 806 such that it encapsulates these components with only simple joints (typically staples or glue joints) at the edges. The cardboard frame edges that have been partially perforated or cut can then be folded over and glue sealed to each other so as to form a lip 880. A self-adhering compressible gasket material 870 (such as glue backed polyurethane foam) is then attached to this lip 880 (in case of the FIG. 7 embodiment) or on to the broad surfaces of the filter frame (FIG. 3 embodiment). Note that the two flat surfaces of the pleated filter material 814 are glue sealed to the inner surfaces of the filter frame 852 while the other pleated surfaces arc scaled against a compressible layer of felt 882 (typically polyester), that are attached to the corresponding inner surfaces of the frame 852 (FIG. 8A). Other traditional methods of filter element construction may also be used for these embodiments.

Applicability and Use of the Electrostatically Stimulated Filtering Device

There have been many investigations regarding the effect of air ions on biological aerosols. The results of these studies generally point to the decay or increased death rate of bacteriophage and virus aerosols. Hence air ionization has been suggested as a method for controlling air contaminants bacteria in swine buildings and for control of Newcastle disease virus in chicken farms. Virus particles are known to survive in indoor air for as long as 2.5 hours depending on humidity and other conditions.

Filter media, having a large surface area can become a breeding ground for bacteria, thus leading to, for example, the propagation of Legionnaires' disease. An advantage of the EEF is that any biological aerosol caught on the filter are continuously exposed to the ionizing radiation, thus achieving an extremely high kill rate. Only biological particles that penetrate through the filter may survive, if the ionization dose received as they are passed through is not high enough to kill them. Under the ionization conditions of the invention growth of the bioaerosol on the filter medium is retarded or eliminated due to the ionization radiation produced and due to the fact that the filter and the bacterial and other biological organisms caught on the filter, are held within this field for an infinite time period.

Besides having application in the poultry and swine farming industries, discussed above, such a device is useful for indoor air pollution control. Many diseases, e.g., tuberculosis and the common cold, are often spread by inhaling biological aerosols. The present invention not only provides for a more efficient method of filtering out such aerosols, but also eliminates them by destroying the biological cells and thus prevents their growth on the filter medium.

Another potential use of this feature is in the pharmaceutical and food industry. In the manufacture of many foods and drugs biologically safe environments are necessary. Further in other areas such as semiconductor clean rooms biological growth on filters can dramatically increase the amount of contamination in the clean room. This device eliminates the potential for growth of biological aerosols on the filter medium.

Radon gas degenerates into progeny that form small submicron particles that have high charge levels. There have been some investigations[1] regarding removal of these particles by electrostatic means. An advantage of the EEF is that the device can take advantage of the inherent charge of the radon progeny particles and capture them by means of the high electrical fields within the EEF.

[1]Bigu J., and E. Edwardson *Effect of Air Cleaner on Thoron Progeny*, Canada Centre of Mineral and Energy Technology, Division Report MRL 91-065 (TR), 1991.

The EEF is highly effective in removing all types of particles from indoor and process air cleaning applications.

I claim:

1. A filter portion for an electrostatically stimulated filtering device, said filter portion comprising:

filter means for entrapping contaminants in a fluid medium drawn through said filter means;

downstream electrode means, positioned downstream of said filter means, electrically connected for carrying a first potential;

ionizing electrode means, positioned upstream of said filter means, electrically connected for carrying a second potential; and control electrode means, positioned upstream of said ionizing electrode means, electrically connected for carrying a third potential with said first potential and said third potential being substantially lower in magnitude than said second potential, said ionizing electrode means creating a first ionizing field between said ionizing electrode means and said control electrode means and a second ionizing field between said ionizing electrode means and said downstream electrode means, and with said filter means positioned within said second ionizing field.

2. The filter portion as claimed in claim 1, wherein said downstream electrode means is in contact with a downstream side of said filter means.

3. The filter portion as claimed in claim 2, wherein a distance between said ionizing electrode means and said downstream electrode means relative to a distance between said ionizing electrode means and said control electrode means preferentially enables electrical arcing, as a result of overvoltage, to occur between said ionizing electrode means and said control electrode means instead of between said ionizing electrode means and said downstream electrode means.

4. The filter portion as claimed in claim 3, wherein a distance between said ionizing electrode means and said control electrode means is in a range of 0.375 to 1.5 inches, a ratio of a distance between said ionizing electrode means and said control electrode means to a distance between said ionizing electrode means and said downstream electrode means is in a range of 0.45 to 0.95, and a voltage between said ionizing electrode means and said control electrode means is in a range having as a lower limit a voltage of not less than seven kilo-Volts.

5. The filter portion as claimed in claim 3, wherein a first distance between said ionizing electrode means and said control electrode means is in a range of 0.375 to 1.5 inches, a ratio of a said first distance to a second distance between said ionizing electrode means and said downstream electrode means is in a range of 0.45 to 0.95, and a ratio of voltage between said ionizing electrode means and said control electrode means to said first distance is in a range having as a lower limit a voltage per centimeter of separation between said ionizing electrode means and said control electrode means of not less than four kilo-Volts per centimeter.

6. The filter portion of claim 2, wherein said filter means comprises a dielectric filter material disposed between said downstream electrode means and said ionizing electrode means.

7. The filter portion of claim 6, wherein said ionizing electrode means comprises a planar array of ionizing wires parallel to said control electrode means and said downstream electrode means.

8. The filter portion of claim 6, wherein a distance between said ionizing electrode means and said downstream electrode means relative to a distance between said ionizing electrode means and said control electrode means enables electrical arcing, as a result of overvoltage, to occur between said ionizing electrode means and said control electrode means instead of between said ionizing electrode means and said downstream electrode means.

9. The filter portion of claim 6, wherein said filter means comprises pleated filter material, a distance between said ionizing electrode means and said control electrode means is approximately 1.5 inch, a ratio of said distance between said ionizing means and said control electrode means and a distance between said ionizing electrode means and said downstream electrode means is between 0.45 and 0.95, and a voltage between said ionizing electrode means and said control electrode means is in a range having as a lower limit a voltage of not less than seven kilo-Volts.

10. The filter portion of claim 6, wherein said control electrode means comprises a metal mesh prefilter.

11. The filter portion of claim 6, wherein said filter means comprises pleated filter material, a first distance between said ionizing electrode means and said control electrode means is approximately 1.5 inch, a ratio of said first distance and a second distance between said ionizing electrode means and said downstream electrode means is between 0.45 and 0.95, and voltage between said ionizing electrode means and said control electrode means is in a range having as a lower limit a voltage per centimeter of separation between said ionizing electrode means and said control electrode means of not less than four kilo-Volts per centimeter.

12. The filter portion as claimed in claim 1, wherein said first potential and said third potential are ground potentials.

13. The filter portion as claimed in claim 1, wherein a distance between said ionizing electrode means and said downstream electrode means relative to a distance between said ionizing electrode means and said control electrode means preferentially enables electrical arcing, as a result of overvoltage, to occur between said ionizing electrode means and said control electrode means instead of between said ionizing electrode means and said downstream electrode means.

14. The filter portion as claimed in claim 36, wherein said filter means comprises pleated filter material, a distance between said ionizing electrode means and said control electrode means of approximately 1.5 inch, a ratio of said distance between said ionizing means and said control electrode means and a distance between said ionizing electrode means and said downstream electrode means of between 0.45 to 0.95, and a potential difference between said ionizing electrode means and said control electrode means of in a range having as a lower limit a voltage of not less than 7 kilo-Volts.

15. The filter portion as claimed in claim 1, wherein said filter means comprises:

an upstream pleated dielectric layer exhibiting a first conductivity; and a downstream pleated conductive layer exhibiting a second and greater conductivity than said first layer.

16. The filter portion as claimed in claim 1, wherein said filter means comprises:

an upstream pleated dielectric layer exhibiting a first conductivity; and a downstream pleated conductive layer exhibiting a second and greater conductivity s than said first layer, said downstream conductive layer being in contact with said downstream electrode means.

17. A filter portion as claimed in claim 16, wherein said downstream conductive layer is comprised of fibers coated with carbon powder.

18. A filter portion as claimed in claim 16, wherein said downstream conductive layer comprises carbonized fibers.

19. A filter portion as claimed in claim 16, wherein said upstream dielectric layer is fiberglass.

20. A filter portion as claimed in claim 16, wherein said downstream conductive layer comprises a metal screen.

21. The filter portion as claimed in claim 16, wherein a distance between said ionizing electrode means and said control electrode means in a range of 0.375 to 1.25 inches, a ratio of a distance between said ionizing electrode means and said control electrode means to a distance between said ionizing electrode means and peaks of said downstream pleated conductive layer of said filter means is in a range of 0.6 to 0.9 and a voltage between said ionizing electrode means and said control electrode means is in a range having as a lower limit a voltage of not less than 7 kilo-Volts.

22. The filter portion as claimed in claim 16, wherein a distance between said ionizing electrode means and said control electrode means is equal to approximately one inch, a distance between said ionizing electrode and peaks of said downstream pleated filter conductive layer is approximately 1.25 inches, and a voltage between said ionizing electrode means and said control electrode means is approximately 12 kilo-Volts.

23. The filter portion as claimed in claim 16, wherein a distance between said ionizing electrode means and said control electrode means is in a range of 0.375 to 1.25 inches, a ratio of a distance between said ionizing electrode means and said control electrode means to a distance between said ionizing electrode means and peaks of said downstream pleated conductive layer of said filter means is in a range of 0.6 to 0.9, and a voltage between said ionizing electrode means and said control electrode means is in a range having as a lower limit a voltage per centimeter of separation between said ionizing electrode means and said control electrode means of not less than four kilo-Volts per centimeter.

24. The filter portion as claimed in claim 1, further comprised of said first potential and said third potential being substantially equal in magnitude.

25. The filter portion as claimed in claim 1, wherein said filter means comprises pleated dielectric filter material.

26. The filter portion as claimed in claim 1, wherein said filter means comprises flat dielectric filter material.

27. The filter portion as claimed in claim 1, wherein said ionizing electrode means comprises a planar array of ionizing wires parallel to said control electrode means and said downstream electronic means.

28. The filter portion as claimed in claim 44, further comprised of a distance between said ionizing electrode means and said downstream electrode means relative to a distance between said ionizing electrode means and said control electrode means provides preferential accommodation of electrical arcing between said ionizing electrode means and said control electrode means instead of between said ionizing electrode means and said downstream electrode means.

29. The filter portion as claimed in claim 28, wherein said filter means comprises pleated filter material having a pleat depth, a distance between said ionizing electrode means and said control electrode means is approximately equal to said pleat depth, and a distance between said ionizing electrode means and said downstream electrode means is equal to said pleat depth plus between 0.25 and 0.5 inches.

30. The filter portion as claimed in claim 1, further comprised of said filter means comprising pleated filter material having a pleat depth of approximately one inch, a distance between said ionizing electrode means and said control electrode means of approximately inch, a distance between said ionizing electrode means and said downstream electrode means of approximately 1.5 inches, and a voltage between said ionizing electrode means and said control electrode means being not less than seven kilo-Volts.

31. The filter portion as claimed in claim 1, wherein said control electrode means comprises a metal mesh prefilter.

32. The filter portion as claimed in claim 1, wherein said filter means comprises:

an upstream pleated dielectric layer; and a downstream pleated conductive layer.

33. The filter portion as claimed in claim 32, further comprised of said downstream conductive layer comprising fibers coated with carbon powder.

34. The filter portion as claimed in claim 32, further comprised of said downstream conductive layer comprising carbonized fibers.

35. The filter portion as claimed in claim 32, further comprised of said upstream dielectric layer comprising fiberglass.

36. The filter portion as claimed in claim 32, further comprised of said downstream conductive layer comprising metal screens.

37. The filter portion as claimed in claim 32, further comprised of a distance between said ionizing electrode means and said control electrode means is within a range of 0.375 to 1.5 inches, a ratio of the distance between said ionizing electrode means and said control electrode means to the distance between said ionizing electrode means and a nearest surface of said downstream conductive layer is within a range of 0.6 to 0.9, and a voltage between said ionizing electrode means and said control electrode means is not less than seven kilo-Volts.

38. The filter portion as claimed in claim 32, further comprised of a distance between said ionizing electrode means and said control electrode means being equal to approximately one inch, a distance between said ionizing electrode and peaks of said upstream pleated filter dielectric layer being 1.25 inches approximately, and a voltage between said ionizing electrode means and said control electrode means being not less than seven kilo-Volts.

39. The filter portion as claimed in claim 32, further comprised of a first distance between said ionizing electrode means and said control electrode means is within a range of 0.375 to 1.5 inches, a ratio of said first distance to a second distance between said ionizing electrode means and a nearest surface of said downstream conductive layer means is within a range of 0.6 to 0.9, and a potential difference between said ionizing electrode means and said control electrode means is in a range having as a lower limit a voltage per centimeter of separation between said ionizing electrode means and said control electrode means of not less than four kilo-Volts per centimeter.

40. The filter portion as claimed in claim 1, further comprised of a distance between said ionizing electrode means and said control electrode means being closer than a distance between said ionizing electrode means and said downstream electrode means, and a voltage between said ionizing electrode means and said control electrode means being not less than seven kilo-Volts.

41. The filter portion of claim 1, comprised of:

a ratio of a first distance between said ionizing electrode means and said control electrode means, and a second distance between said ionizing electrode means and said downstream electrode means is in a range of 0.45 to 0.95; and a voltage between said second potential and said third potential, and said first distance is in a range having as a lower limit a voltage per centimeter of separation between said ionizing electrode means and said control electrode means of not less than four kilo-Volts per centimeter.

42. The filter portion as claimed in claim 1, wherein said filter means comprises a first distance between said ionizing electrode means and said control electrode means is in a range of 0.375 to 1.5 inches, a ratio of said first distance and a second distance between said ionizing electrode means and said downstream electrode means of between 0.45 to 0.95, and a potential difference between said ionizing electrode means and said control electrode means is in a range having as a lower limit a voltage per centimeter of separation between said ionizing electrode means and said control electrode means of not less than four kilo-Volts per centimeter.

43. An electrostatically stimulated filtering device, comprising:

a housing having a fluid intake and a fluid exhaust;

upstream electrode means, positioned downstream of said fluid intake, electrically connectable for carrying a first potential;

filter material, positioned downstream of and spaced-apart from said upstream electrode means, for filtering out contaminants in fluid passing from said fluid intake to said fluid exhaust;

ionizing electrode means, disposed between and spaced-apart from said filter material and said upstream electrode means, electrically connectable for carrying a second potential;

downstream electrode means, positioned downstream of said filter material, electrically connectable for carrying a third potential;

said ionizing electrode means creating a first ionizing field between said ionizing electrode means and said upstream electrode means, and creating a second ionizing field between said ionizing electrode means and said downstream electrode means with said first potential and said third potential being substantially lower in magnitude than said second potential, and with said filter material positioned within said second ionizing field; and means for driving said fluid through said filter material.

44. The filtering device of claim 43, further comprised of said upstream electrode means comprising a prefilter, mounted downstream of said air intake, for performing coarse filtering on fluid-drawn through said air intake.

45. The filtering device of claim 44, wherein ionization of said fluid medium occurs in electric fields established between said downstream electrode means, said ionizing electrode means, and said prefilter and wherein distances between said ionizing electrode means, said downstream electrode means, and said prefilter are adjusted so that, upon application of over voltage, arcing will occur between said ionizing electrode means and said prefilter instead of between said ionizing electrode means and said downstream electrode means.

46. The filtering device of claim 54, further comprising:

ionization of said fluid medium occurring in electric fields established between said downstream electrode means, said ionizing electrode means, and said profilter, and distances between said ionizing electrode means, said downstream electrode means, and said prefilter disposed to provide preferential accommodation of arcing between said ionizing electrode means and said prefilter instead of between said ionizing electrode means and said downstream electrode means.

47. The filtering device of claim 43, wherein said first potential and said third potential are ground potentials.

48. The filtering device of claim 43, further comprising said first potential and said third potential being substantially equal in magnitude.

49. The electrostatically stimulated filtering device as claimed in claim 43, further comprised of a distance between said ionizing electrode means and said upstream electrode means being closer than a distance between said ionizing electrode means and said downstream electrode means, and a voltage between said ionizing electrode means and said upstream electrode means being not less than seven kilo-Volts.

50. The electrostatically stimulated filtering device as claimed in claim 43, further comprised of a first distance between said ionizing electrode means and said upstream electrode means being closer than a second distance between said ionizing electrode means and said downstream electrode means, and potential difference between said ionizing electrode means and said upstream electrode means is in a range having as a lowest limit a voltage per centimeter of separation between said ionizing electrode means and said upstream electrode means of not less than four kilo-Volts per centimeter.

51. The filtering device of claim 43, comprised of:

a ratio of a first distance between said ionizing electrode means and said upstream electrode means, and a second distance between said ionizing electrode means and said downstream electrode means, is in a range of 0.45 to 9.5; and a potential difference between said second potential and said first potential, and said first distance, is in a range having as a lower limit a voltage per centimeter of separation between said ionizing electrode means and said upstream electrode means of not less than four kilo-Volts per centimeter.

52. A filter element for an electrostatically stimulated filtering device, said filter element comprising:

filter material comprising an upstream dielectric layer and a downstream relatively conductive layer relatively more conductive than said upstream dielectric layer;

said relatively conductive layer being disposed for carrying a first potential;

ionizing electrode means, positioned upstream of and spaced-apart from said filter material, electrically connectable for carrying a second potential substantially greater in magnitude than said first potential;

control electrode means, positioned upstream from said ionizing electrode means and said filter means, electrically connectable for carrying a third potential substantially lesser in magnitude than said second potential;

said ionizing electrode means being closer to said control electrode means than to said relatively conductive layer;

means for connecting said relatively conductive layer to said first potential;

means for providing said second potential to said ionizing electrode means;

means for connecting said control electrode means to said third potential; and a frame for supporting said filter material.

53. The filter clement of claim 52, further comprising downstream electrode means disposed in contact with said downstream relatively conductive layer and supported by said frame.

54. The filter element of claim 52, comprised of:

a ratio of a first distance between said ionizing electrode means and said control electrode means, and a second distance between said ionizing electrode means and said downstream relatively conductive layer is in a range of 0.45 to 0.95; and a ratio of a difference between said second potential and said third potential and said first distance is in a range having as a lower limit a voltage per centimeter of separation between said ionizing electrode means and said control electrode means of not less than four kilo-Volts per centimeter.

55. A method for filtering air in an electrostatically stimulated filtering device, comprising:

setting a first distance between an ionizing electrode and a downstream electrode relative to a second distance between said ionizing electrode and a control electrode to provide preferential accommodation of electrical arcing between said ionizing electrode and said control electrode instead of between said ionizing electrode and said downstream electrode; and successively drawing air to be filtered past said upstream electrode while maintaining said upstream electrode at a first reference potential, then drawing the air through said ionizing electrode while maintaining said ionizing electrode at a second potential higher than said first reference potential, then drawing the air through a filter material, and then drawing the air through said downstream electrode while maintaining said downstream electrode at a third reference potential, with said first potential and said third potential being substantially lower in magnitude than said second potential.

56. A method as claimed in claim 55, wherein said filter material comprises a relatively conductive downstream layer relatively more conductive than a dielectric upstream layer, said relatively conductive layer being in electrical and physical contact with said downstream electrode to substantially carry said third reference potential.

57. The method of claim 55, comprised of:

maintaining a ratio between said second distance and said first distance within a range of 0.45 to 0.95; and maintaining a ratio of a difference between said second potential and said first reference potential, and said second distance within a range having as a lower limit a voltage per centimeter of separation between said ionizing electrode means and said control electrode means of not less than four kilo-Volts per centimeter.

58. An electrostatically stimulated filtering device, comprising:

a ionizer assembly having a plurality of faces;

a planar array of a plurality of ionizing wires electrically connectable for carrying a first potential, strung across each of said plurality of faces of said ionizer assembly;

a plurality of prefilter elements each affixed to a first side of each of said plurality of faces of said ionizer assembly;

a plurality of filter elements each affixed to a second side of said plurality of faces of said ionizer assembly;

a plurality of downstream electrode means, positioned downstream from said filter elements in a path of a fluid passing through said plurality of filter elements, for carrying a second potential; and a plurality of control electrode means positioned upstream from said plurality of ionizing wires electrically connectable for carrying a third potential with said first potential and said third potential being substantially lower in magnitude than said second potential, said plurality of ionizing wires creating a first field of ionization between said plurality of ionizing wires and said plurality of control electrode means and creating a second ionizing field between said plurality of ionizing wires and said plurality of downstream electrode means, and said plurality of filter elements positioned within said second field of ionization.

59. The electrostatically stimulated filtering device of claim 58, wherein said ionizer assembly is substantially cubic.

60. The filtering device of claim 58, further comprised of said first potential and said third potential being substantially equal.

61. The filtering device of claim 58, comprising:

a ratio of a first least distance between said plurality of ionizing wires and said plurality of control electrode means, and a second least distance between said plurality of ionizing wires and said plurality of downstream electrode means, is in a range of 0.45 to 0.95; and a ratio of a difference between said first potential and said third potential, and said first distance, is in a range having as a lower limit a voltage per centimeter of separation between said ionizing electrode means and said control electrode means of not less than four kilo-Volts per centimeter.

62. A method of destroying bacterial and biological organisms, comprising:

providing a filter for entrapping said bacterial and biological organisms passing with a fluid medium drawn through said filter;

providing downstream electrode means positioned downstream of said filter, and electrically connecting said downstream electrode means for carrying a first potential;

providing ionizing electrode means positioned upstream of and spaced-apart from said filter, and electrically connecting said ionizing electrode means for carrying a second potential;

providing control electrode means positioned upstream of said ionizing electrode means, and electrically connecting said control electrode means for carrying a third potential;

creating a first field of ionization between said ionization electrode means and said control electrode means, and a second field of ionization between said ionizing electrode means and said downstream electrode means with said first potential and said third potential being substantially lower in magnitude than said second potential.

63. The method of claim 62, comprising:

maintaining said ionizing electrode means separated by a first distance from said downstream electrode means;

maintaining said control electrode means separated by a second lesser distance from said ionizing electrode means;

maintaining a ratio between said second distance and said first distance within a range of 0.45 to 0.95; and maintaining a ratio of a difference between said second potential and said third potential, and said second distance, within a range having as a lower limit a voltage per centimeter of separation between said ionizing electrode means and said control electrode means of not less than four kilo-Volts per centimeter.

* * * * *